US009802078B2

(12) United States Patent
Yeh

(10) Patent No.: US 9,802,078 B2
(45) Date of Patent: Oct. 31, 2017

(54) HIGH KNEES EXERCISE APPARATUS

(71) Applicant: PREVENTIVE MEDICAL HEALTH CARE CO., LTD., Taoyuan (TW)

(72) Inventor: Ching-Yu Yeh, Taichung (TW)

(73) Assignee: PREVENTIVE MEDICAL HEALTH CARE CO., LTD., Taoyuan (TW)

( * ) Notice: Subject to any disclaimer, the term of this patent is extended or adjusted under 35 U.S.C. 154(b) by 92 days.

(21) Appl. No.: 14/834,370

(22) Filed: Aug. 24, 2015

(65) Prior Publication Data

US 2015/0360078 A1 Dec. 17, 2015

Related U.S. Application Data

(63) Continuation of application No. 14/185,936, filed on Feb. 21, 2014, now Pat. No. 9,155,933.
(Continued)

(30) Foreign Application Priority Data

Mar. 18, 2013 (TW) ..... 102204977 U

(51) Int. Cl.

| | |
|---|---|
| ***A63B 22/06*** | (2006.01) |
| ***A63B 23/04*** | (2006.01) |
| ***A63B 21/00*** | (2006.01) |
| ***A63B 22/00*** | (2006.01) |
| ***A63B 22/20*** | (2006.01) |
| ***A63B 21/005*** | (2006.01) |
| *A63B 21/22* | (2006.01) |

(52) U.S. Cl.

CPC ..... *A63B 23/0417* (2013.01); *A63B 21/0051* (2013.01); *A63B 21/00192* (2013.01); *A63B 22/001* (2013.01); *A63B 22/0012* (2013.01); *A63B 22/0017* (2015.10); *A63B 22/0056* (2013.01); *A63B 22/06* (2013.01); *A63B 22/0605* (2013.01); *A63B 22/201* (2013.01); *A63B 21/225* (2013.01); *A63B 2022/0038* (2013.01); *A63B 2022/0041* (2013.01); *A63B 2022/0051* (2013.01); *A63B 2022/0688* (2013.01); *A63B 2022/206* (2013.01); *A63B 2208/0204* (2013.01); *A63B 2208/0233* (2013.01)

(58) Field of Classification Search

CPC ..... A63B 22/14; A63B 22/16; A63B 22/20; A63B 22/06; A63B 22/0605; A63B 22/0664; A63B 22/0694; A63B 22/08; A63B 22/201; A63B 22/203; A63B 22/205; A63B 22/206; A63B 22/208

See application file for complete search history.

(56) References Cited

U.S. PATENT DOCUMENTS

| | | | | |
|---|---|---|---|---|
| 3,759,511 A * | 9/1973 | Zinkin et al. | ..... | 482/51 |
| 4,550,908 A * | 11/1985 | Dixon | ..... | 482/113 |
| 5,836,855 A * | 11/1998 | Eschenbach | ..... | A63B 22/001 482/51 |

* cited by examiner

*Primary Examiner* — Loan H Thanh
*Assistant Examiner* — Rae Fischer
(74) *Attorney, Agent, or Firm* — CKC & Partners Co., Ltd.

(57) ABSTRACT

A high knees exercise apparatus includes a base, a driving mechanism, a linkage mechanism and two magnetic resistance. The driving mechanism is located on the base and includes two driving member which is driven swung along arc path. The linkage mechanism is for leading the driving members swung reversely in response to each other. The two magnetic resistance devices are for providing magnetic resistances in accordance with swings of the two driving members respectively.

12 Claims, 28 Drawing Sheets

Related U.S. Application Data

(60) Provisional application No. 61/879,151, filed on Sep. 18, 2013.

HIGH KNEES EXERCISE APPARATUS

RELATED APPLICATIONS

The present application is a continuation of the application Ser. No. 14/185,936, filed Feb. 21, 2014, the entire contents of which are hereby incorporated herein by reference, which claims priority to Taiwan Application Serial Number 102204977, filed Mar. 18, 2013, and U.S. Provisional Patent Application No. 61/879,151, filed Sep. 18, 2013, which are herein incorporated by reference.

BACKGROUND

Technical Field

The present disclosure relates to an exercise apparatus. More particularly, the present disclosure relates to a high knees exercise apparatus.

Description of Related Art

Exercise apparatuses make raining day and limited ground no longer be problems of doing exercise. Therefore, exercise apparatuses are main priority for modern people who are always busy but want to keep in shape. It is well-known that walking and running are body exercise which not only can burn calories and firm muscles but also can enhance myocardial function and increase lung capacity. Accordingly, treadmills, steppers, and elliptical trainers are most common exercise apparatus compared to others on the present market. However, users barely lift their knees high when using those exercise apparatus and improvements of muscle strength and body shape are mostly concentrated on their calf only.

High knees exercise is usually taken as a component of warm-up exercise to get heart rate going and also can burn calories and firm muscles as walking and running. This exaggerated knee motion further provides an excellent workout for the knees, hips, lower body, lower abdomen, and lower back and can enhance body strength, speed, balance, and flexibility. But, no apparatus for executing high knees exercise has been developed nowadays.

SUMMARY

According to one aspect of the present disclosure, a high knees exercise apparatus includes a base, a driving mechanism, a linkage mechanism and two magnetic resistance devices. The base includes a bottom base, a first supporting base, a second supporting base and a seat base. The first supporting base is disposed on the bottom base, the second supporting base is disposed on the bottom base, and the seat base disposed on the first supporting base. The driving mechanism includes two pivoting members, two driving members and two pedals. The pivoting members are symmetrically and pivotally connected to two sides of the first supporting base respectively. One end of each of the driving members is connected to each of the pivoting members, wherein each of the driving members is swung along an arc path. The pedals are connected to each of the driving members respectively. The linkage mechanism is linked up with the pivoting members for leading the driving members swung reversely in response to each other. The magnetic resistance devices are for providing magnetic resistances in accordance with swings of the two driving members respectively.

According to another aspect of the present disclosure, a high knees exercise apparatus includes a base, two slide rails, a driving mechanism, a linkage mechanism and two magnetic resistance devices. The base includes a bottom base, a first supporting base, a second supporting base and a seat base. The first supporting base is disposed on the bottom base, the second supporting base is disposed on the bottom base, and the seat base is disposed on the first supporting base. The slide rails are disposed on the bottom base and located on two sides of each of the first supporting base and the second supporting base respectively, wherein each of the slide rails is arc-shaped which extend from the second supporting base to the first supporting base. The driving mechanism includes two pivoting members, two driving members and two pedals. The pivoting members are symmetrically and pivotally connected to two sides of the first supporting base respectively. One end of each of the driving members is connected to each of the pivoting member, the other end of each of the driving members is slidably connected to the two slide rails respectively. The pedals are connected to each of the driving members respectively. The linkage mechanism is linked up with the pivoting members for leading the driving members slid reversely and relatively to each other. The magnetic resistance devices are for providing magnetic resistances in accordance with slides of the two driving members respectively.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
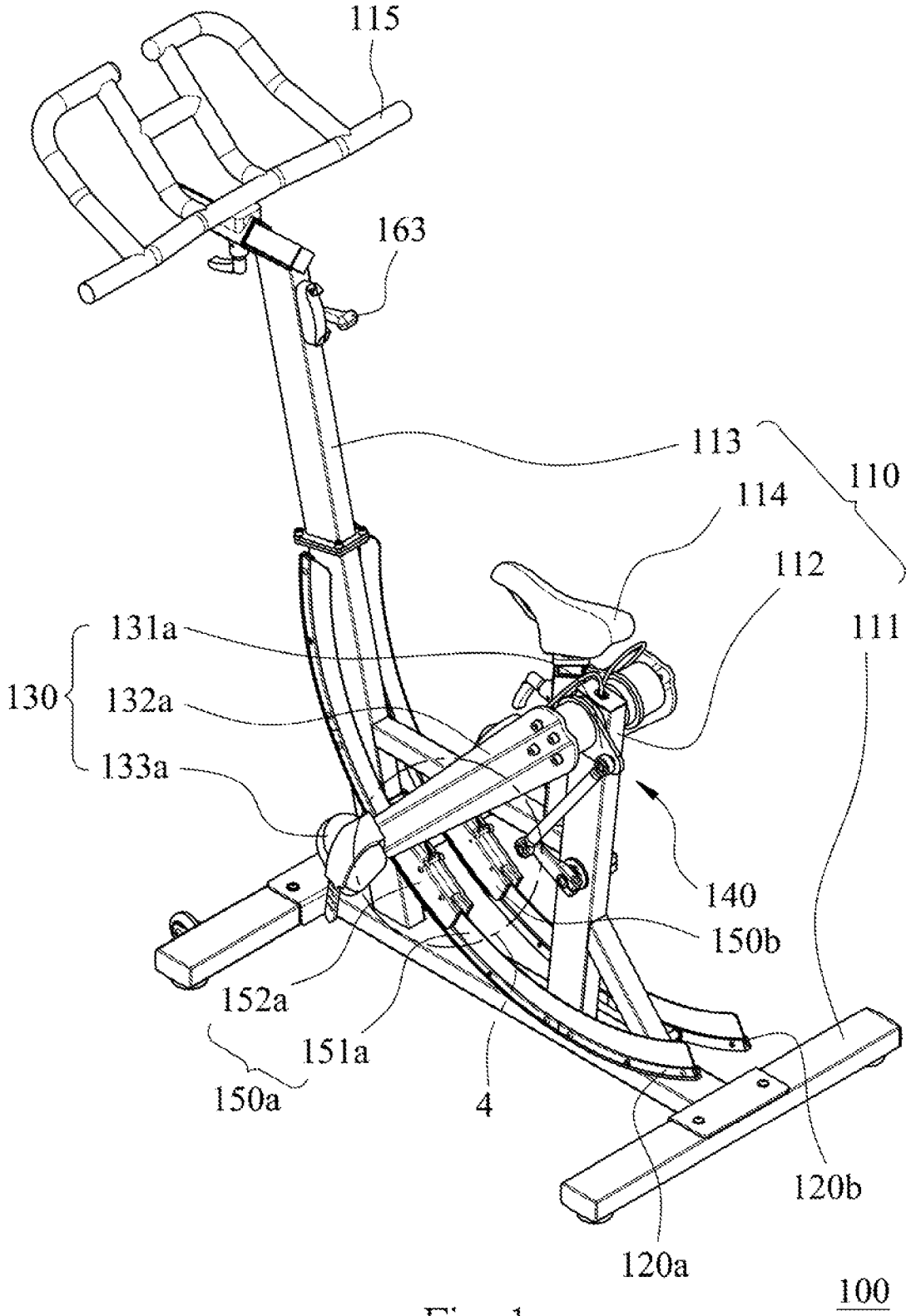
FIG. 1 shows a three dimensional view of a high knees exercise apparatus according to one embodiment of the present disclosure.

FIG. 1 shows a three dimensional view of a high knees exercise apparatus 100 according to one embodiment of the present disclosure. In FIG. 1, the high knees exercise apparatus 100 includes a base 110, two slide rails 120*a*, 120*b*, a driving member 130, a linkage mechanism 140 and two magnetic resistance devices 150*a*, 150*b*.

In detail, the base 110 includes a bottom base 111, a first supporting base 112, a second supporting base 113 and a seat base 114. The first supporting base 112 and the second supporting base 113 are disposed on the bottom base 111. That is, one end of each of the first supporting base 112 and the second supporting base 113 is connected to the bottom base 111. The seat base 114 is disposed on the other end of the first supporting base 112. The user sits on the seat base 114 and faces the second supporting base 113 during using the high knees exercise apparatus 100. Moreover, the base 110 can further includes a handle 115 connected to the second supporting base 113.

The slide rails 120*a*, 120*b* are disposed on the bottom base 111 of the base 110 and located on two sides of each of the first supporting base 112 and the second supporting base 113 respectively. Each of the slide rails 120*a*, 120*b* is arc-shaped which extend from the second supporting base 113 to the first supporting base 112.

The driving mechanism 130 includes two pivot members 131*a*, 131*b*, two driving members 132*a*, 132*b* and two pedals 133*a*, 133*b* (131*b*, 132*b* and 133*b* are not shown in FIG. 1). The two pivot members 131*a*, 131*b* are symmetrically and pivotally connected to two sides of the first supporting base 112 respectively. In each of the driving members 132*a*, 132*b*, one end of the driving member 132*a* is connected to the pivoting member 131*a*, the other end of the driving member 132*a* is slidably connected to the slide rail 120*a*. Therefore, the driving member 132*a* can be driven for swinging along the arc-shaped of the slide rail 120*a*. The pedal 133*a* is connected to the driving members 132*a*. (The relationships among 120*b*, 131*b*, 132*b* and 133*b* are the same with the relationships among 131*a*, 132*a* and 133*a*, and will not describe herein.)

Figure 2:
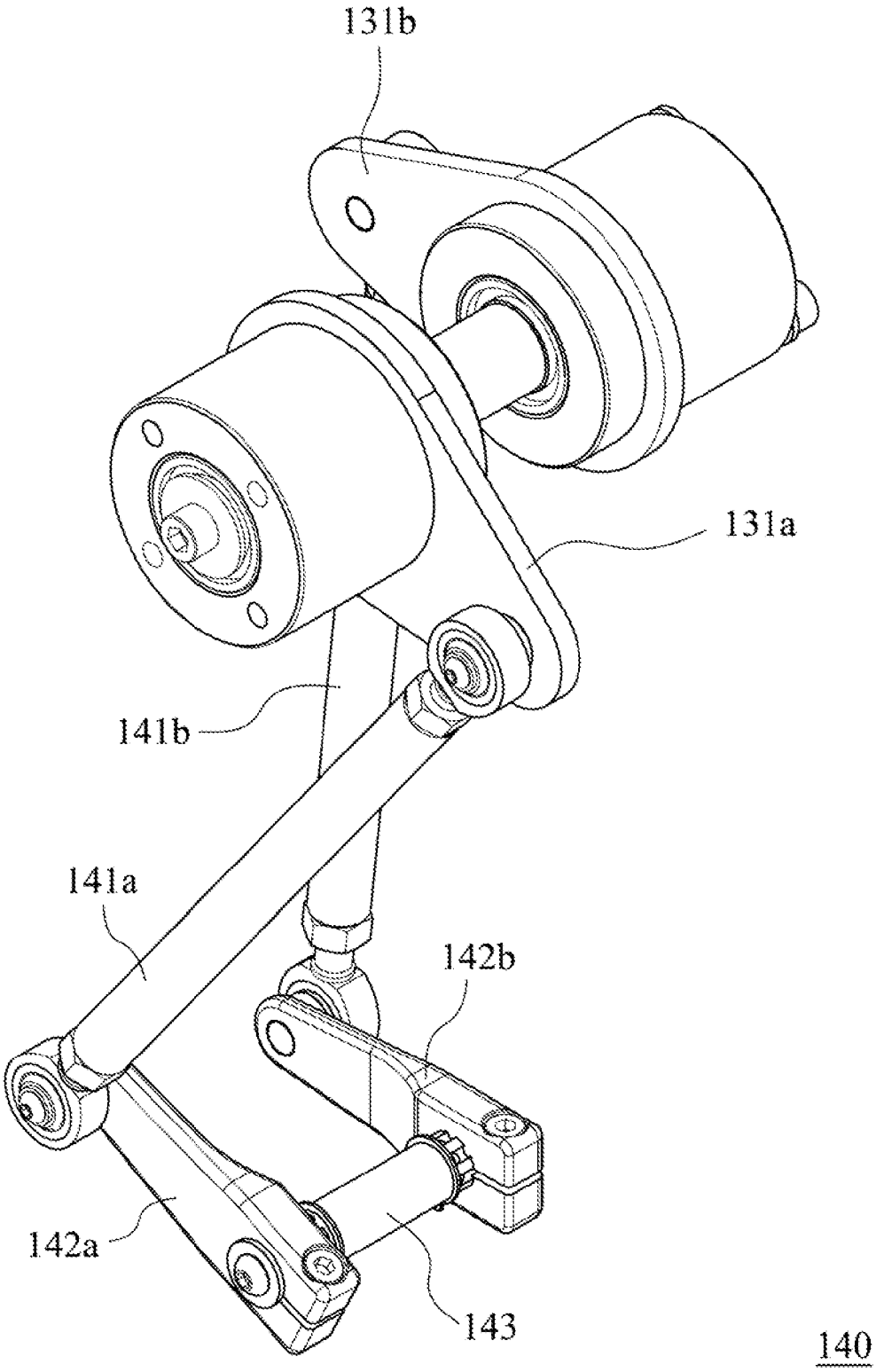
FIG. 2 shows a schematic view of the linkage mechanism of FIG. 1.

The linkage mechanism 140 is linked up with the pivoting members 131*a*, 131*b* for leading the driving members 132*a*, 132*b* slid reversely in response to each other. FIG. 2 shows a schematic view of the linkage mechanism 140 of FIG. 1. In FIG. 2, the linkage mechanism 140 includes two first linkage rods 141*a*, 141*b*, two second linkage rods 142*a*, 142*b* and a rotatable axis 143. One end of each of the first linkage rods 141*a*, 141*b* is connected to each of the pivoting members 131*a*, 131*b*, so that the first linkage rods 141*a*, 141*b* are linked up with the pivoting members 131*a*, 131*b* respectively. One end of each of the second linkage rods 142*a*, 142*b* is pivotally connected to the other end of each of the first linkage rods 141*a*, 141*b*. The rotatable axis 143 pivotally connects the other ends of the two second linkage rods 142*a*, 142*b* to the first supporting base 112. By such arrangement, when the driving members 132*a*, 132*b* are driven, the linkage mechanism 140 can be linked up via the pivoting members 131*a*, 131*b*, and the linkage mechanism 140 leads the two driving members 132*a*, 132*b* slid reversely in response to each other.

Figure 3A:
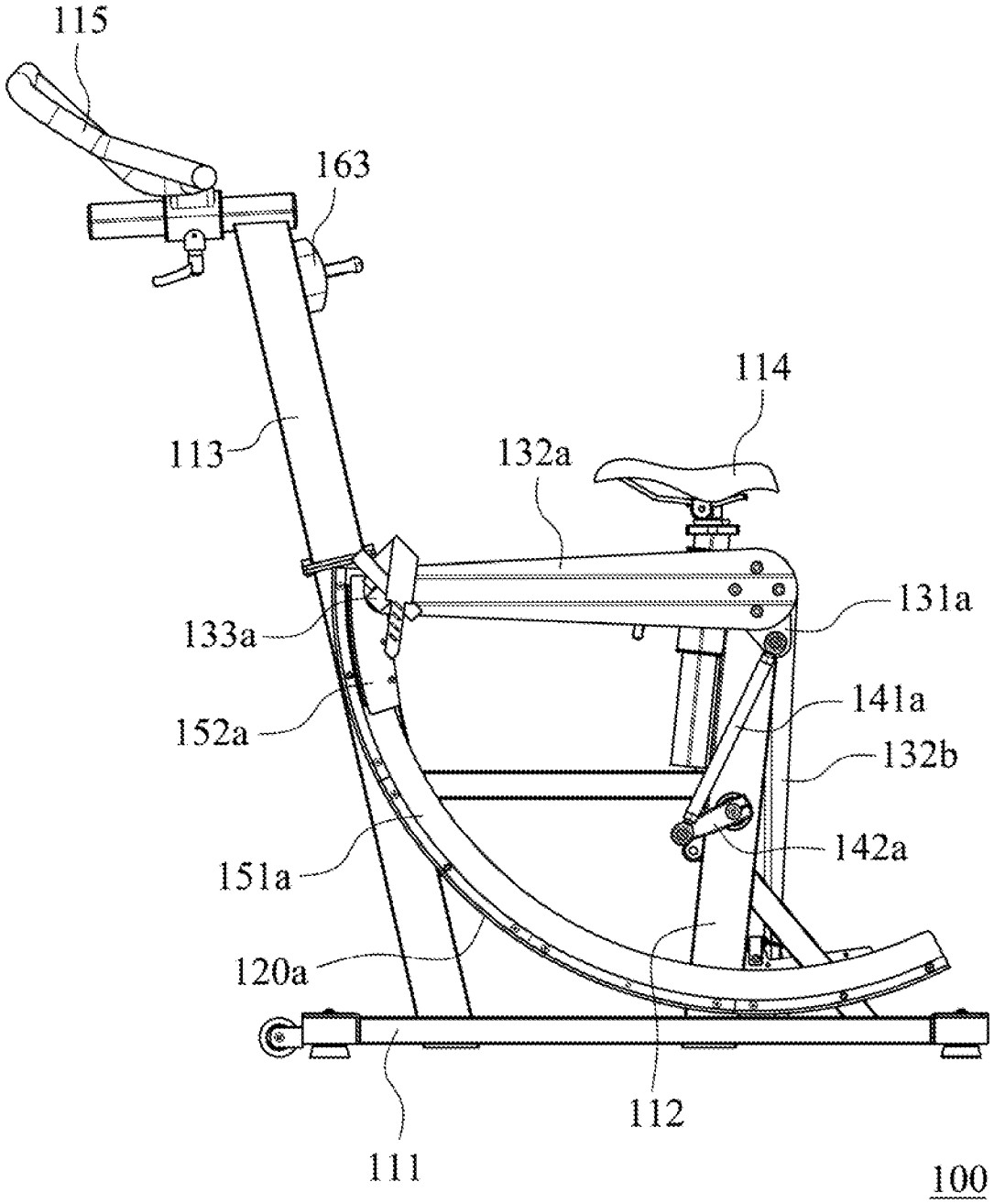
FIG. 3A shows a schematic view of one using state of the high knees exercise apparatus of FIG. 1.
Figure 3B:
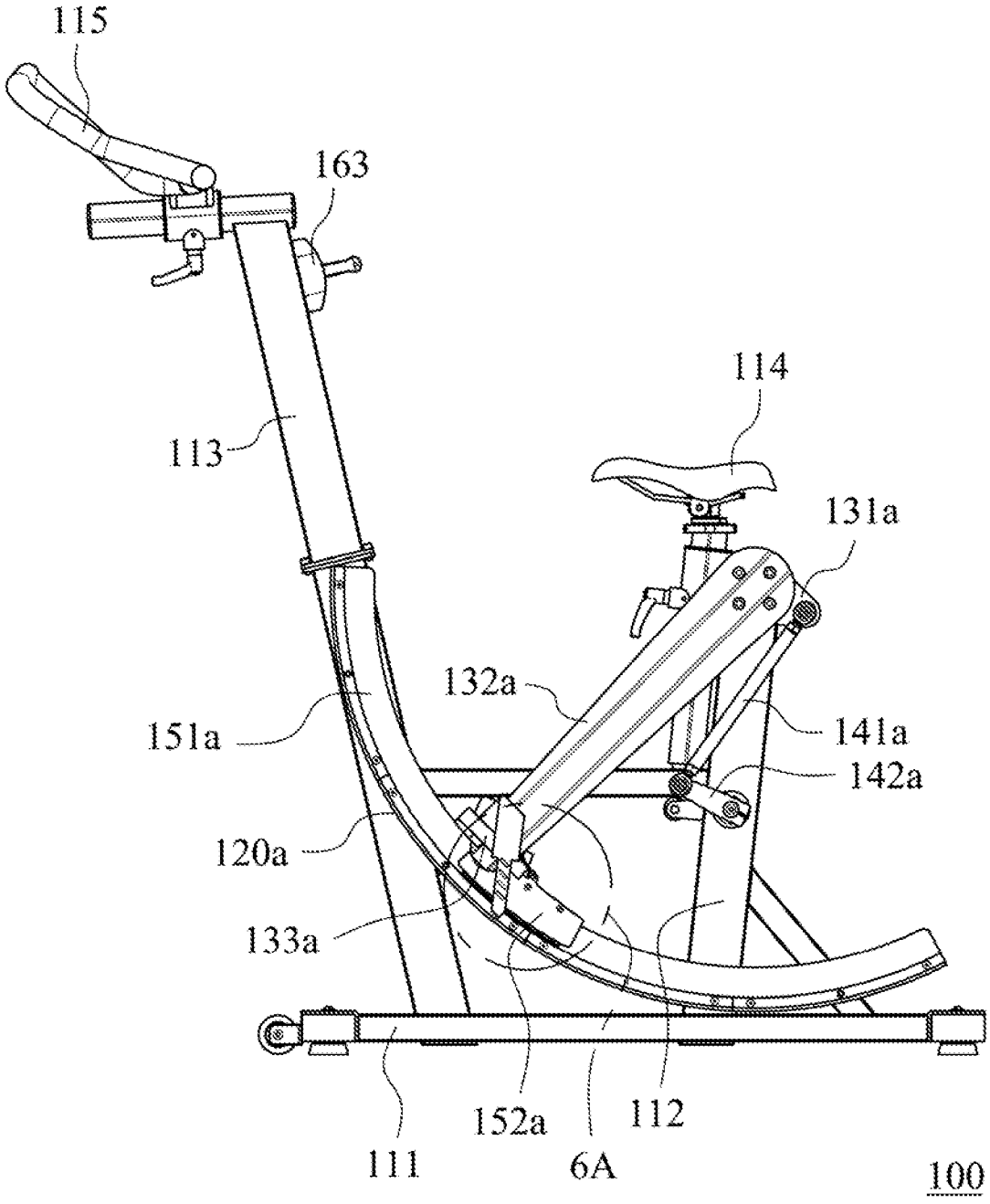
FIG. 3B shows a schematic view of another using state of the high knees exercise apparatus of FIG. 1.
Figure 3C:
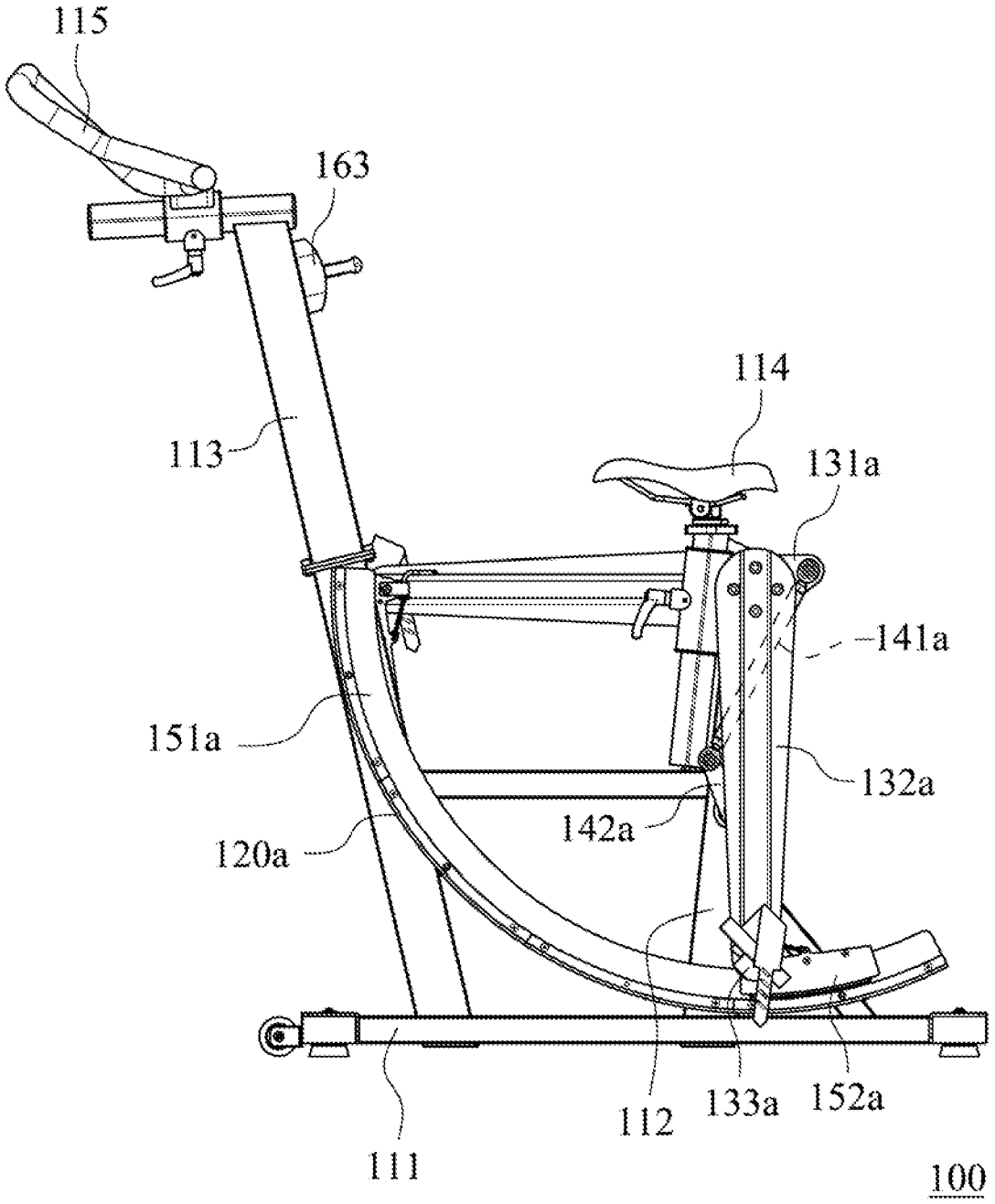
FIG. 3C shows a schematic view of yet another using state of the high knees exercise apparatus of FIG. 1.

FIGS. 3A, 3B and 3C show schematic views of three using states of the high knees exercise apparatus 100 of FIG. 1. In FIG. 3A, when one driving member 132*a* is slid from the first supporting base 112 to the second supporting base 113 along the slide rail 120*a* and is parallel to the ground which is the highest position of the driving member 132*a*, the other driving member 132*b* is perpendicular to the ground. In FIG. 3B, when the driving member 132*a* is slid from the second supporting base 113 to the first supporting base 112, the driving member 132*b* is moved from the first supporting base 112 to the second supporting base 113 along the slide rail 120*b* (in FIG. 3B, the driving member 132*b* just covered by the first supporting base 112). In FIG. 3C, when the driving member 132*a* is perpendicular to the ground, the driving member 132*b* is slid to the end of the slide rail 120*b* and is parallel to the ground. Therefore, the slide direction of the driving member 132*a*, 132*b* can be controlled by the linkage mechanism 140, so that the two driving member 132*a*, 132*b* slid reversely in response to each other.

Figure 4:
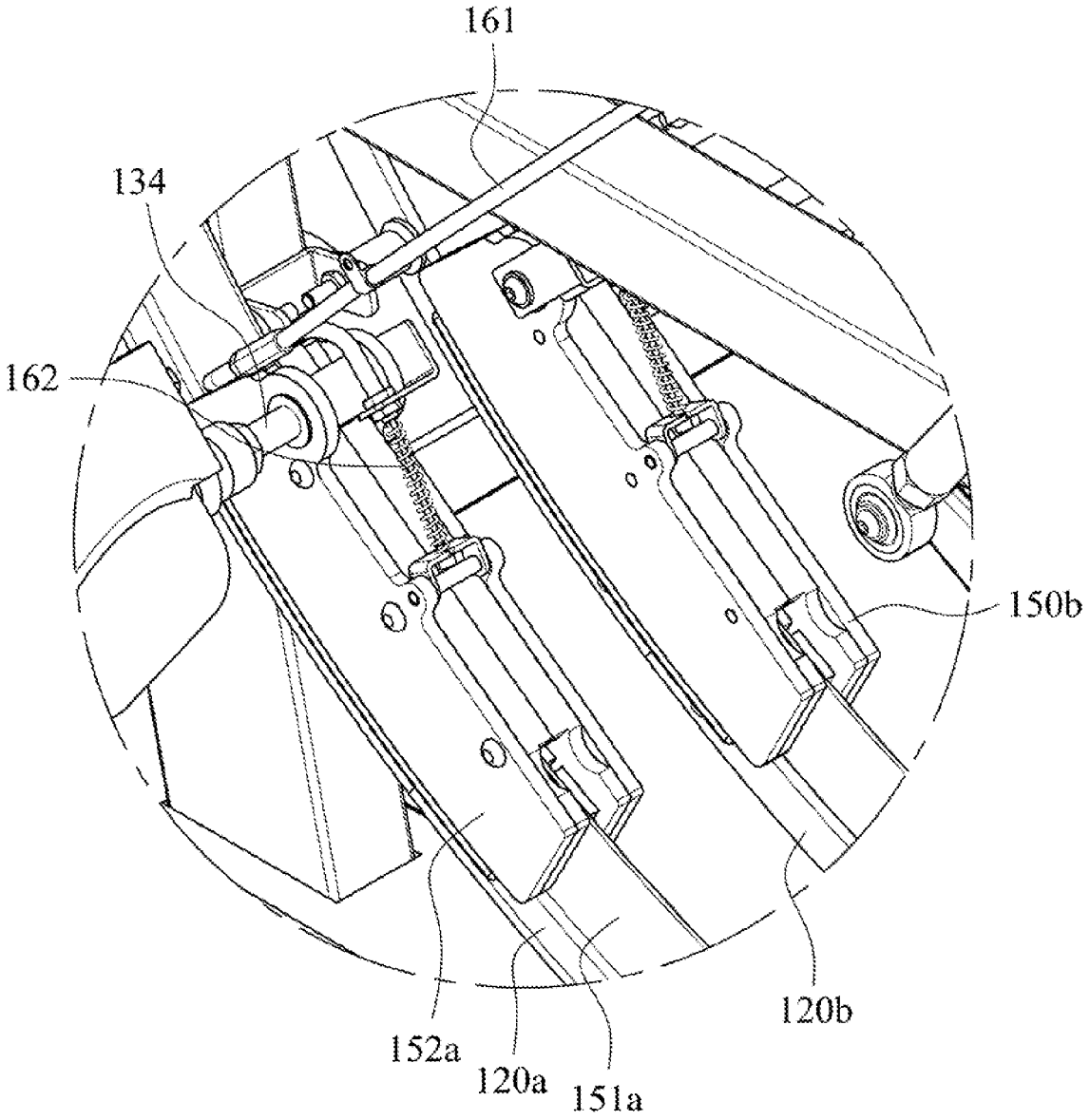
FIG. 4 is an enlarged view of magnetic resistance devices of FIG. 1.

FIG. 4 is an enlarged view of magnetic resistance devices 150*a*, 150*b* of FIG. 1. The two magnetic resistance devices 150*a*, 150*b* are the same, thus, only one magnetic resistance device 150*a* is described and labeled in FIG. 4. The magnetic resistance device 150*a* includes a conductive member 151*a*, a magnet base 152*a* and at least one magnet 153*a* (shown in FIGS. 5B and 5C). The conductive member 151*a* is disposed on the slide rail 120*a*, wherein the conductive member 151*a* can be made of copper, silver, aluminum or steel. The magnet base 152*a* is connected to the driving member 132*a* and linked up with the driving member 132*a*, and is slid along the slide rail 120*a*. In FIG. 4, the conductive member 151*a* is plate-shaped and vertical disposed on the slide rail 120*a*. The conductive member 151*a* is embedded into the magnet base 152*a*, that is, two sides of the conductive member 151*a* are faced to the inner walls of the magnet base 152*a* respectively.

Figure 5A:
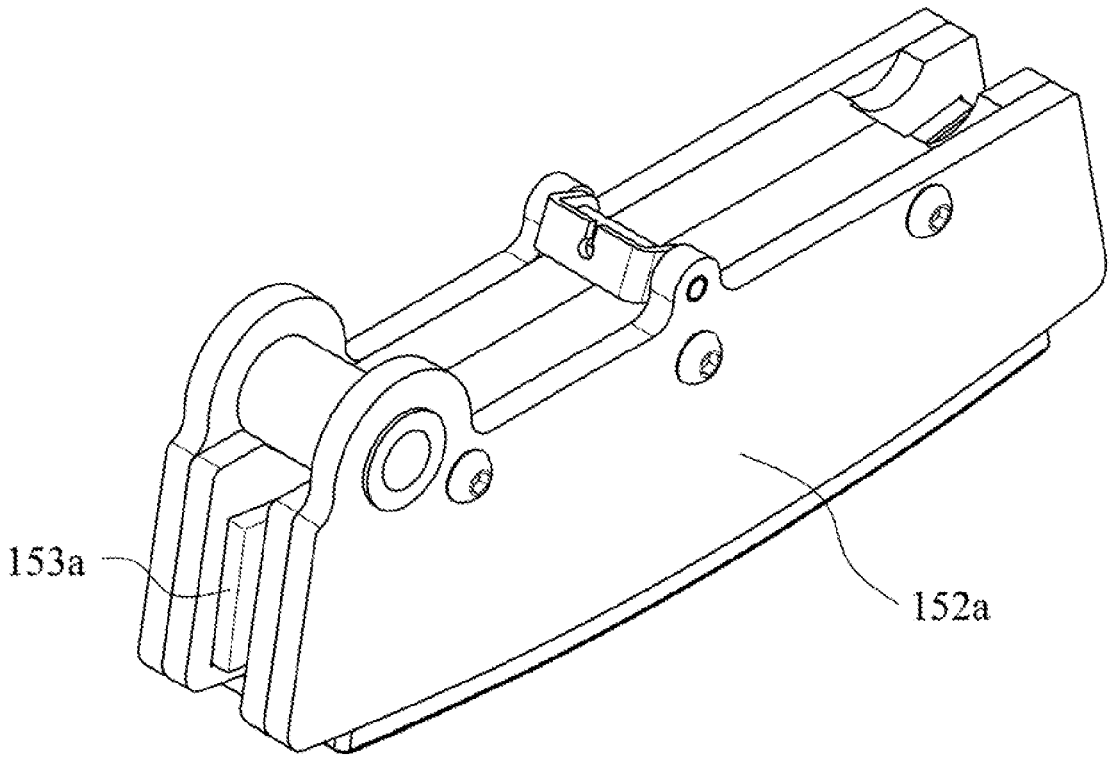
FIG. 5A is a three dimensional view of the magnet base and magnets of FIG. 1.
Figure 5B:
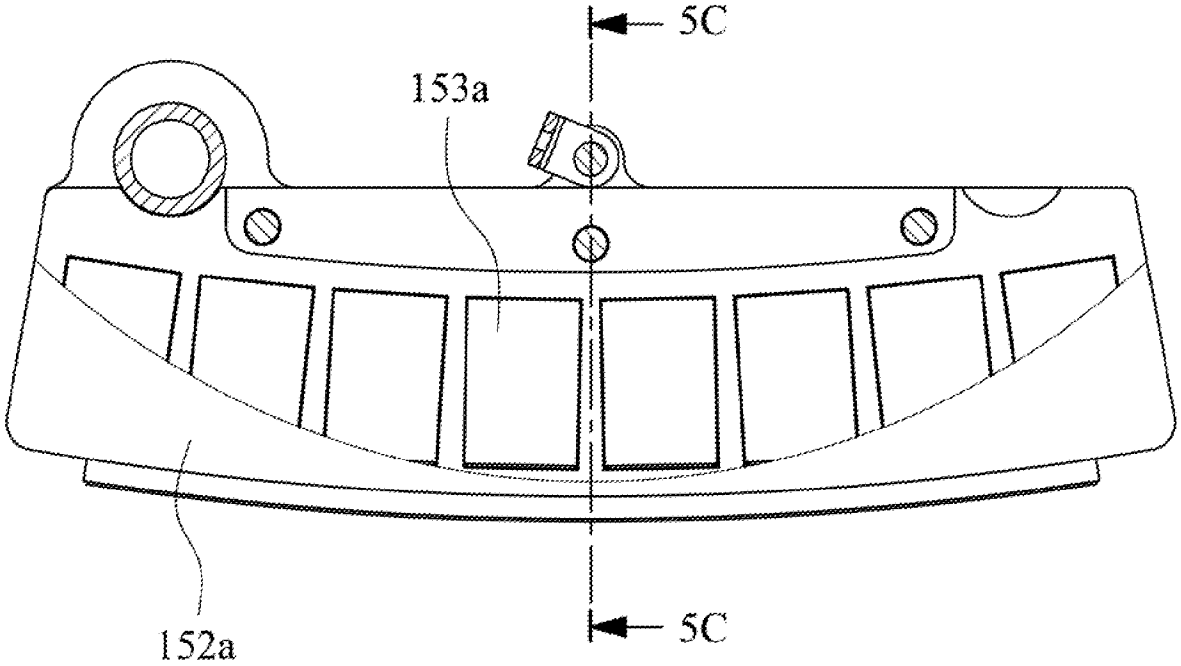
FIG. 5B is a schematic view of the magnet base and the magnets of FIG. 1.
Figure 5C:
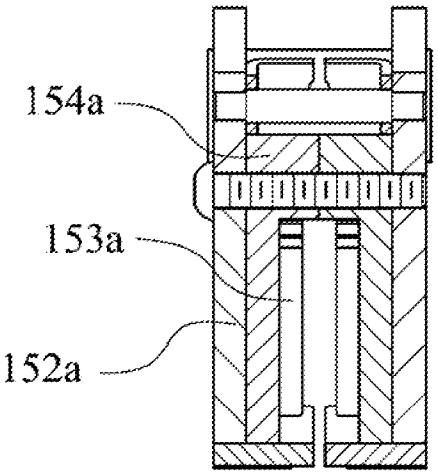
FIG. 5C is a cross-sectional view of the magnet base along line 5C-5C of FIG. 5B.

FIG. 5A is a three dimensional view of the magnet base 152*a* and magnets 153*a* of FIG. 1, FIG. 5B is a schematic view of the magnet base 152*a* and the magnets 153*a* of FIG. 1, and FIG. 5C is a cross-sectional view of the magnet base 152*a* along line 5C-5C of FIG. 5B. In FIGS. 5A-5C, the plurality of magnets 153*a* are arranged on the inner walls of the magnet base 152*a*. Further, the magnets 153*a* can be arranged on the inner walls of the magnet base 152*a* via partitions 154*a*.

The conductive member 151*a* is embedded into the magnet base 152*a*, so that each side of the conductive member 151*a* is faced to the magnets 153*a* which are disposed on each inner wall of the magnet base 152*a*. When the magnet base 152*a* is linked with the driving member 132*a* for sliding along the slide rail 120*a*, a movement between one surface of each of the magnets 153*a* and the surfaces of the conductive member 151*a* which are faced to each other is provided, and the magnetic resistance is generated.

In order to provide an adjustable magnetic resistance function, the high knees exercise apparatus 100 can further include a resistance adjusting device. The resistance adjusting device can change a relative position between the surface of the magnet and the surface of the conductive member. In FIGS. 1 and 4, the resistance adjusting device includes two forcing mechanisms 161, a controlling member 163 and two restoring members 162 (only one forcing mechanism and one forcing mechanism are labelled). The forcing mechanisms 161 can be steel wire ropes. The forcing mechanisms 161 is connected to the magnet base 152*a* of each of the magnetic resistance devices 150*a*. The forcing mechanism 161 is for adjusting an embedded position between the magnet base 152*a* and the conductive member 151*a*. The controlling member 163 is connected to the forcing mechanisms 161 for controlling thereof, wherein the controlling member 163 can be disposed on the second supporting base 113 and adjacent to handle 115 for operating conveniently. The two restoring members 162 are connected to each of the forcing mechanisms 161 and each of the magnet bases 152*a* respectively. The restoring members 162 can have elasticity for restoring the embedded position between the magnet base 152*a* and the conductive member 151*a*.

Figure 6A:
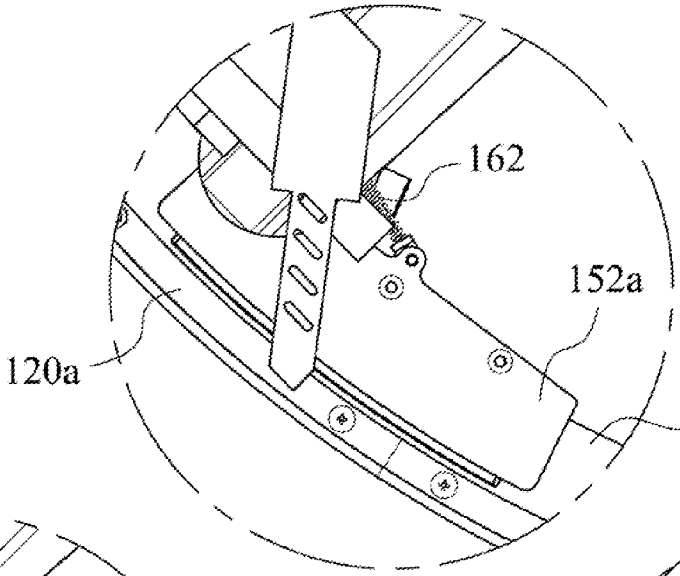
FIG. 6A is a schematic view of one using state between the magnet base and the conductive member of the high knees exercise apparatus of FIG. 3B.
Figure 6C:
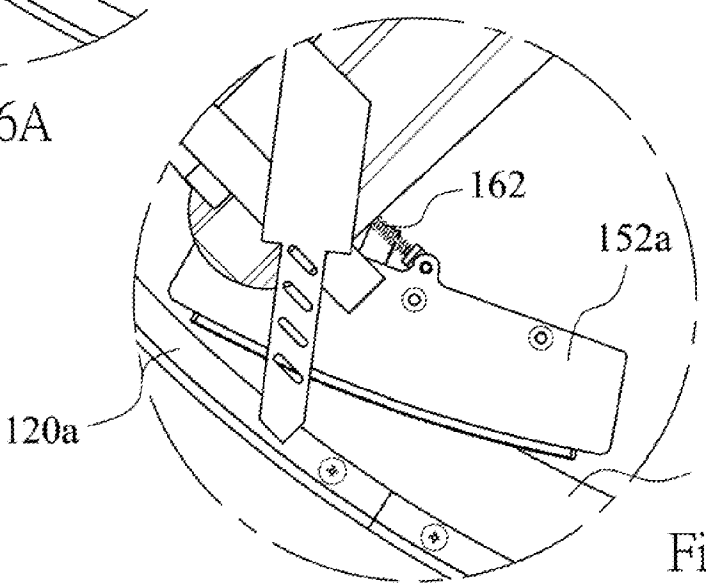
FIG. 6C is a schematic view of yet another using state between the magnet base and the conductive member of the high knees exercise apparatus of FIG. 3B.
Figure 6B:
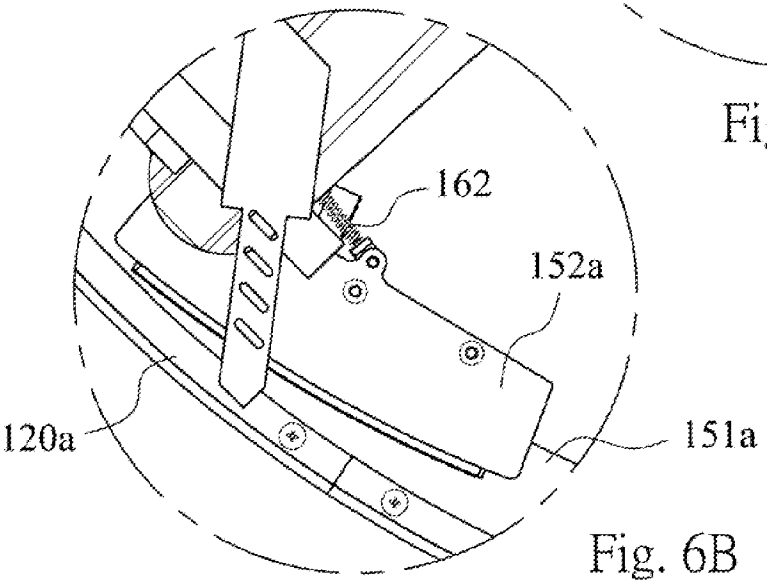
FIG. 6B is a schematic view of another using state between the magnet base and the conductive member of the high knees exercise apparatus of FIG. 3B.

FIGS. 6A, 6B and 6C are schematic views of three using states between the magnet base 152*a* and the conductive member 151*a* of the high knees exercise apparatus 100 of FIG. 3B. In FIG. 4, the magnet base 152 can be pivotally connected to the driving member 132*a* via a connecting axis 134. In FIGS. 6A, 6B and 6C, when the magnet base 152*a* is driven by the forcing mechanism 161 and relatively pivoted to the driving member 132*a*, the embedded position between the magnet base 152*a* and the conductive member 151*a* is changed. Therefore, the facing area between the magnets 153*a* and the conductive member 151*a* is reduced, and the magnetic resistance is reduced.

Figure 7:
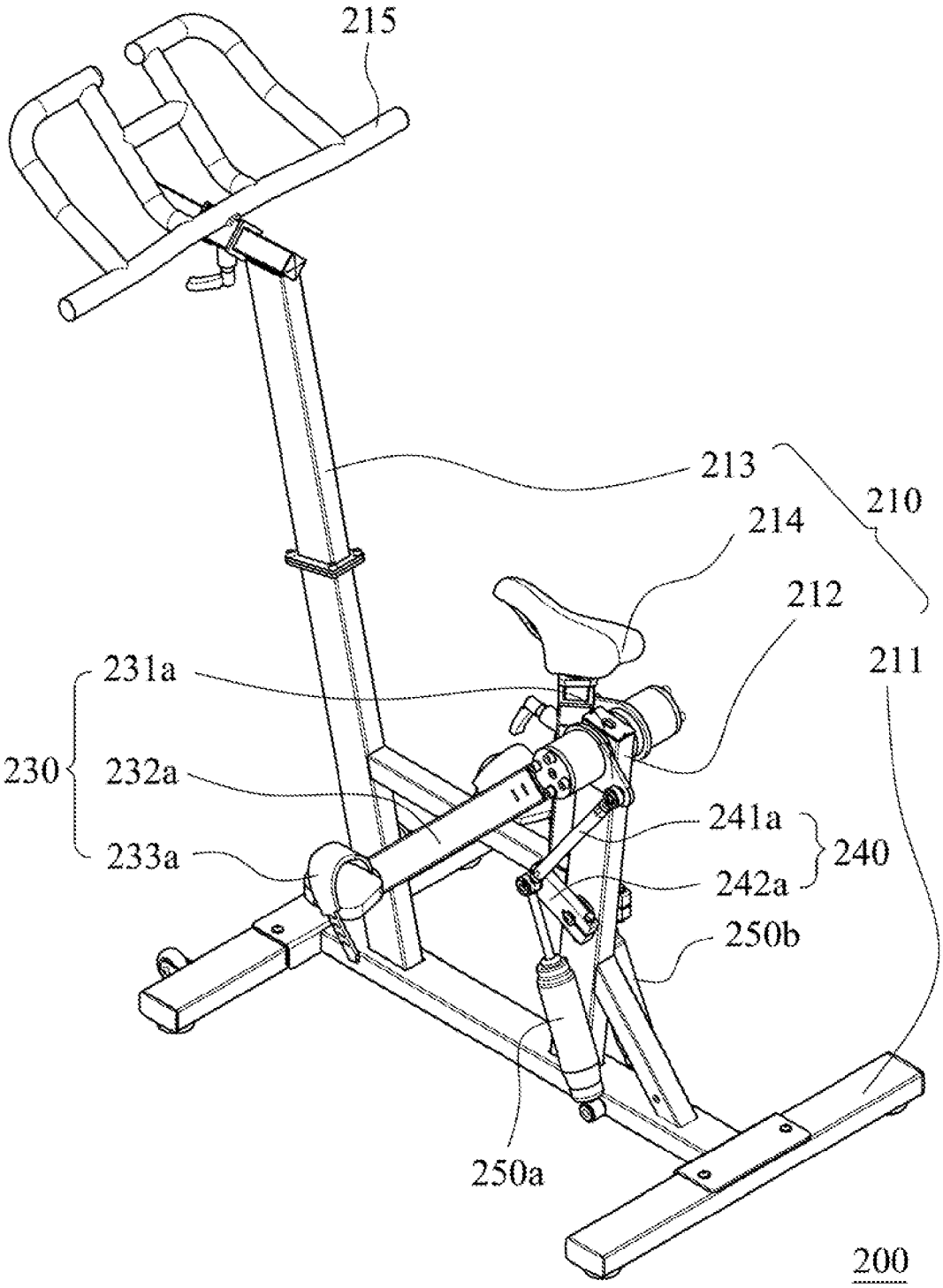
FIG. 7 shows a three dimensional view of a high knees exercise apparatus according to another embodiment of the present disclosure.

FIG. 7 shows a three dimensional view of a high knees exercise apparatus 200 according to another embodiment of the present disclosure. The high knees exercise apparatus 200 includes a base 210, a driving mechanism 230, a linkage mechanism 240 and two magnetic resistance devices 250*a*, 250*b*.

In FIG. 7, the base 210 includes a bottom base 211, a first supporting base 212, a second supporting base 213, a seat base 214 and a handle 215. The relationships among the bottom base 211, the first supporting base 212, the second supporting base 213, the seat base 214 and the handle 215 are the same with the relative elements in FIG. 1, and will not describe again herein.

The driving mechanism 230 includes two pivot members 231*a*, two driving members 232*a* and two pedals 233*a* (the other pivot member, driving member and pedal are not labelled in FIG. 7). The pivoting members 231*a* are symmetrically and pivotally connected to two sides of the first supporting base 212 respectively. One end of each of the driving members 232*a* is connected to each of the pivoting members 231*a*, wherein each of the driving members 232*a* is swung along an arc path. The angle of the arc path can be 45 degrees to 100 degrees. The two pedals 233*a* are connected to each of the driving members 232*a* respectively.

The linkage mechanism 240 includes two first linkage rods 241*a*, two second linkage rods 242*a*, and a rotatable axis (not labelled in FIG. 7, and only one first linkage rod and one second linkage rod are labelled in FIG. 7). The linkage mechanism 240 is linked up with the pivoting members 231*a* for leading the driving members 232*a* swung reversely in response to each other. The detail structure of the linkage mechanism 240 is the same with the illustration in FIG. 2, and will not describe herein again.

Figure 8:
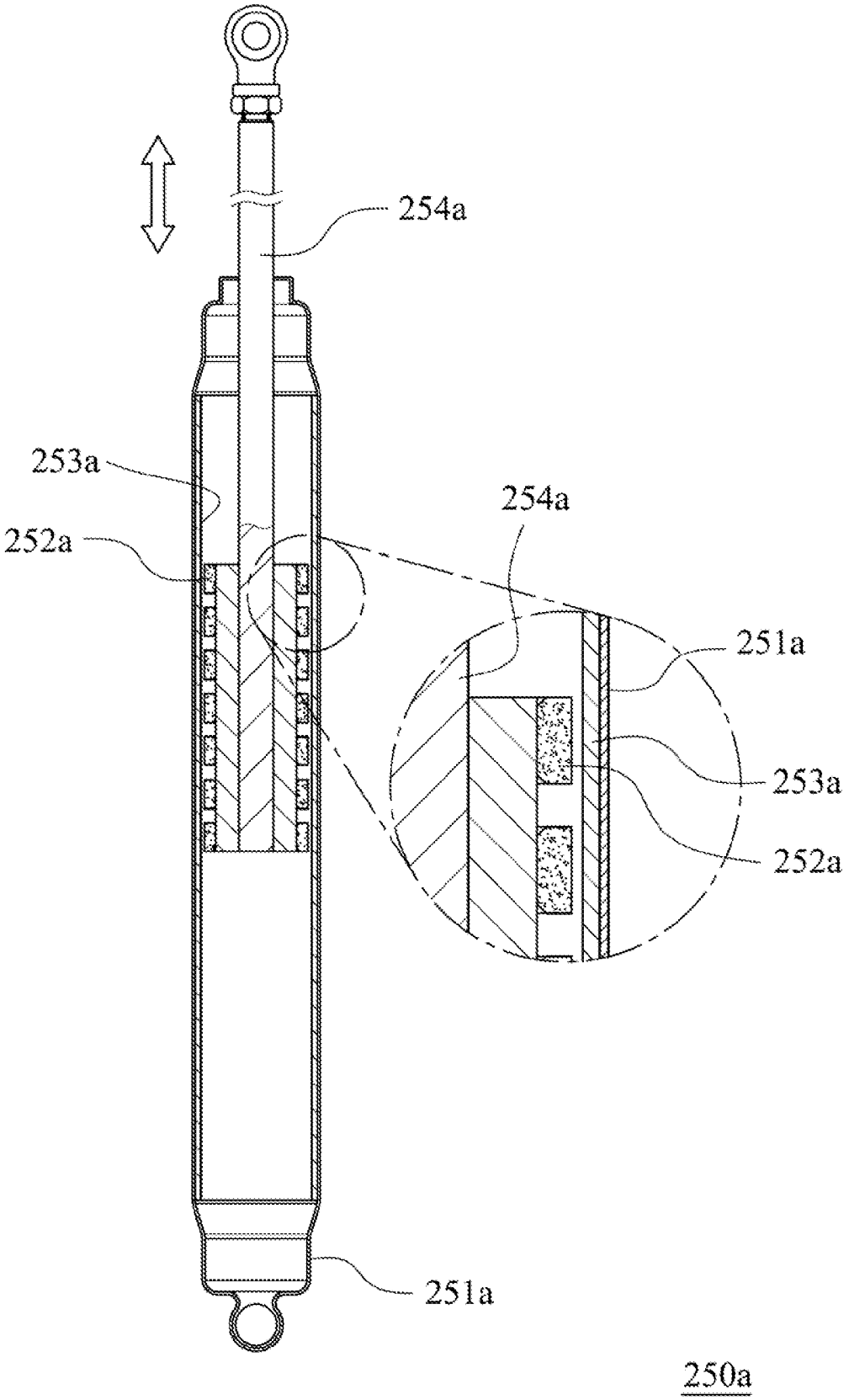
FIG. 8 shows a cross-sectional view of the magnetic resistance device of FIG. 7.

The magnetic resistance devices 250*a*, 250*b* are for providing magnetic resistances in accordance with swings of the two driving members 232*a* respectively. FIG. 8 shows a cross-sectional view of the magnetic resistance device 250*a* of FIG. 7. The magnetic resistance device 250*a* includes a cylinder case 251*a*, a magnetic resistance component assembly, and a piston rod 254*a*, wherein the magnetic resistance component assembly includes magnets 252*a* and a conductive member 253*a*. The cylinder case 251*a* is disposed on the bottom base 211. The magnetic resistance component assembly is located in the cylinder case 251*a*, wherein the conductive member 253*a* is connected to an inner wall of the cylinder case 251*a*, the magnets 252*a* surround the piston rod 254*a*, and the conductive member 253*a* is adjacent to the magnet 252*a*. One end of the piston rod 254*a* is linked up with the linkage mechanism 240 which is linked up with the swings of the driving member 232*a*, so that a movement between the magnet 252*a* and the conductive member 253*a* is provided, and the magnetic resistance is generated.

Figure 9A:
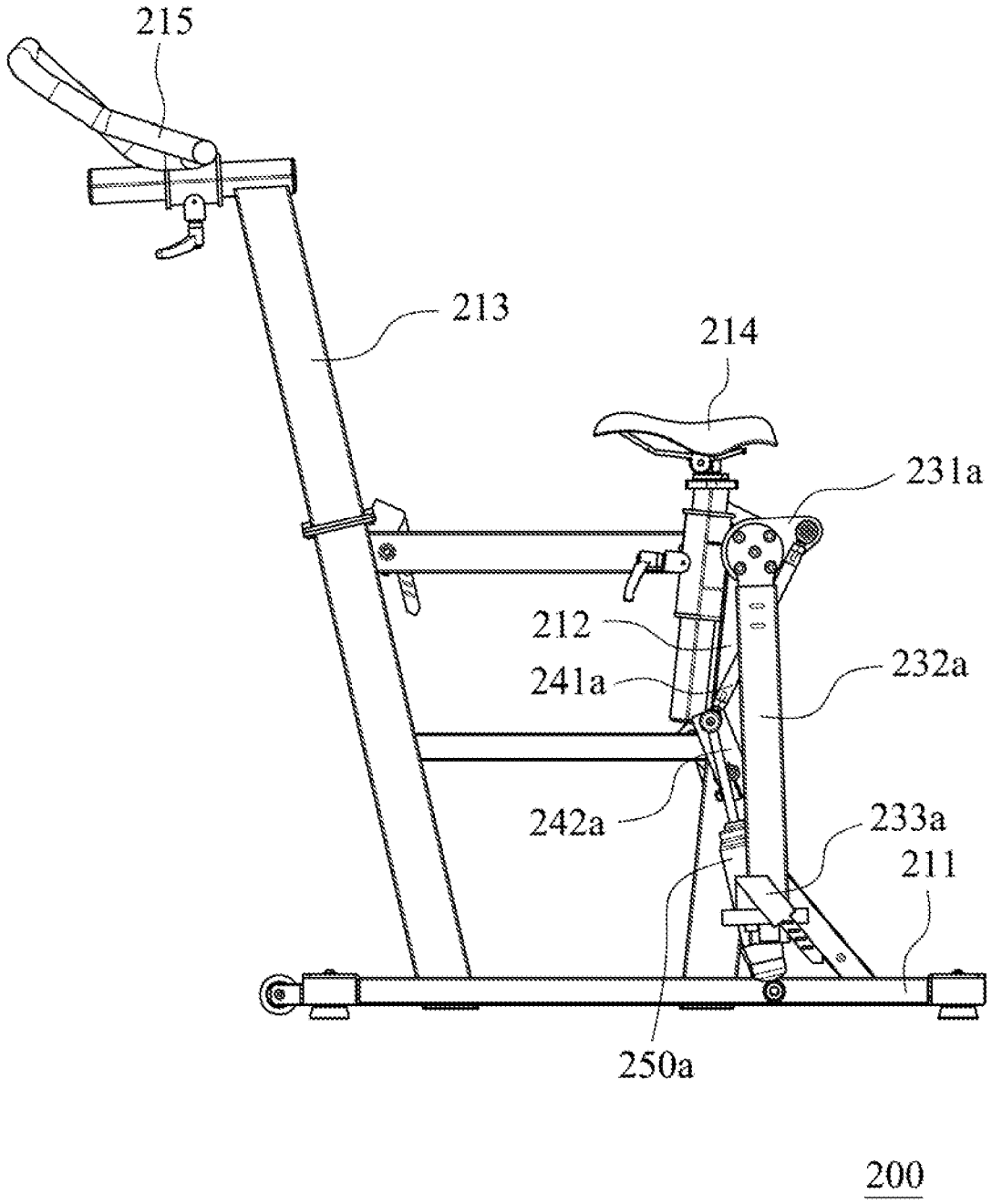
FIG. 9A is a schematic view of one using state of the magnetic resistance device of FIG. 8.
Figure 9B:
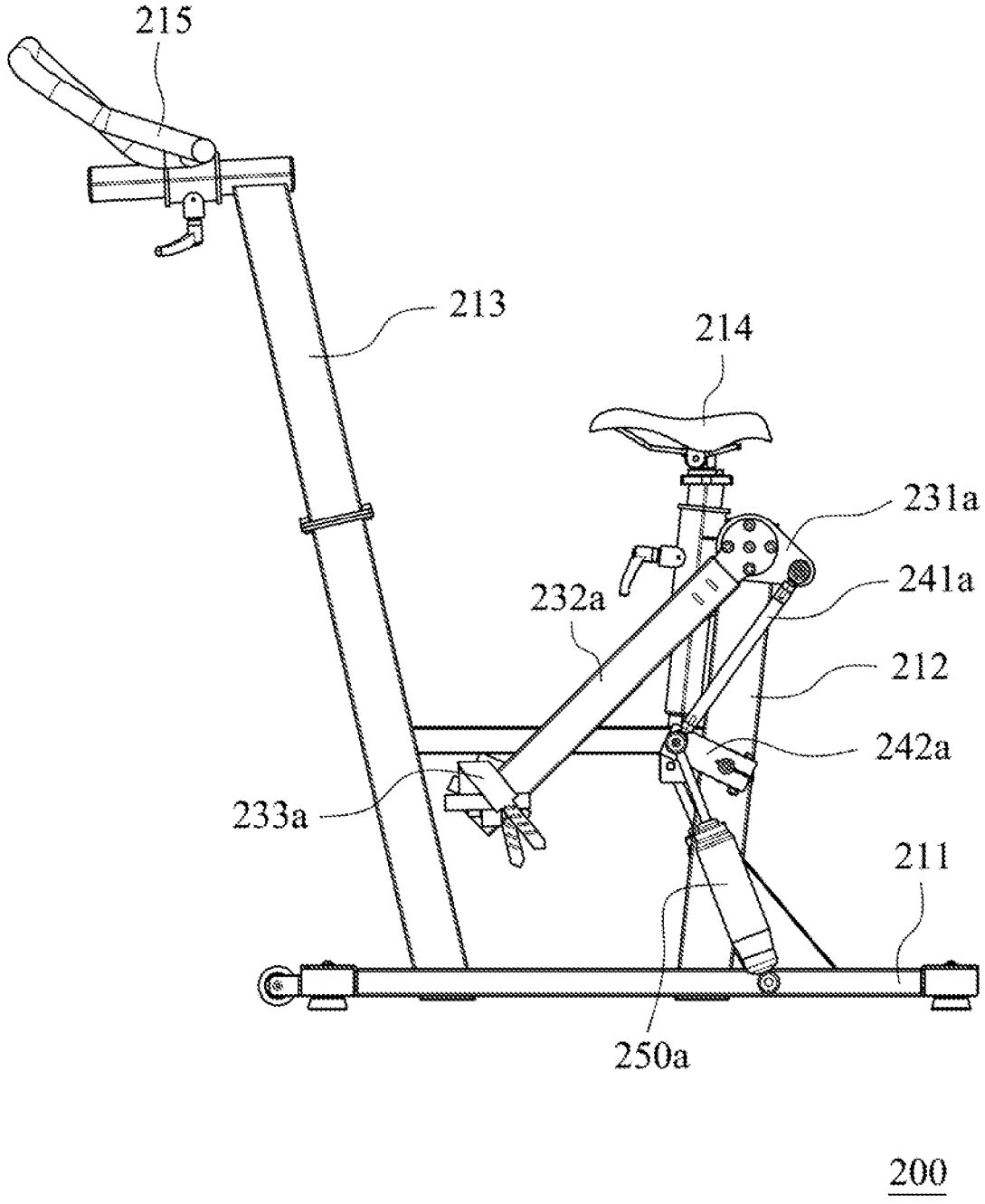
FIG. 9B is a schematic view of another using state of the magnetic resistance device of FIG. 8.
Figure 9C:
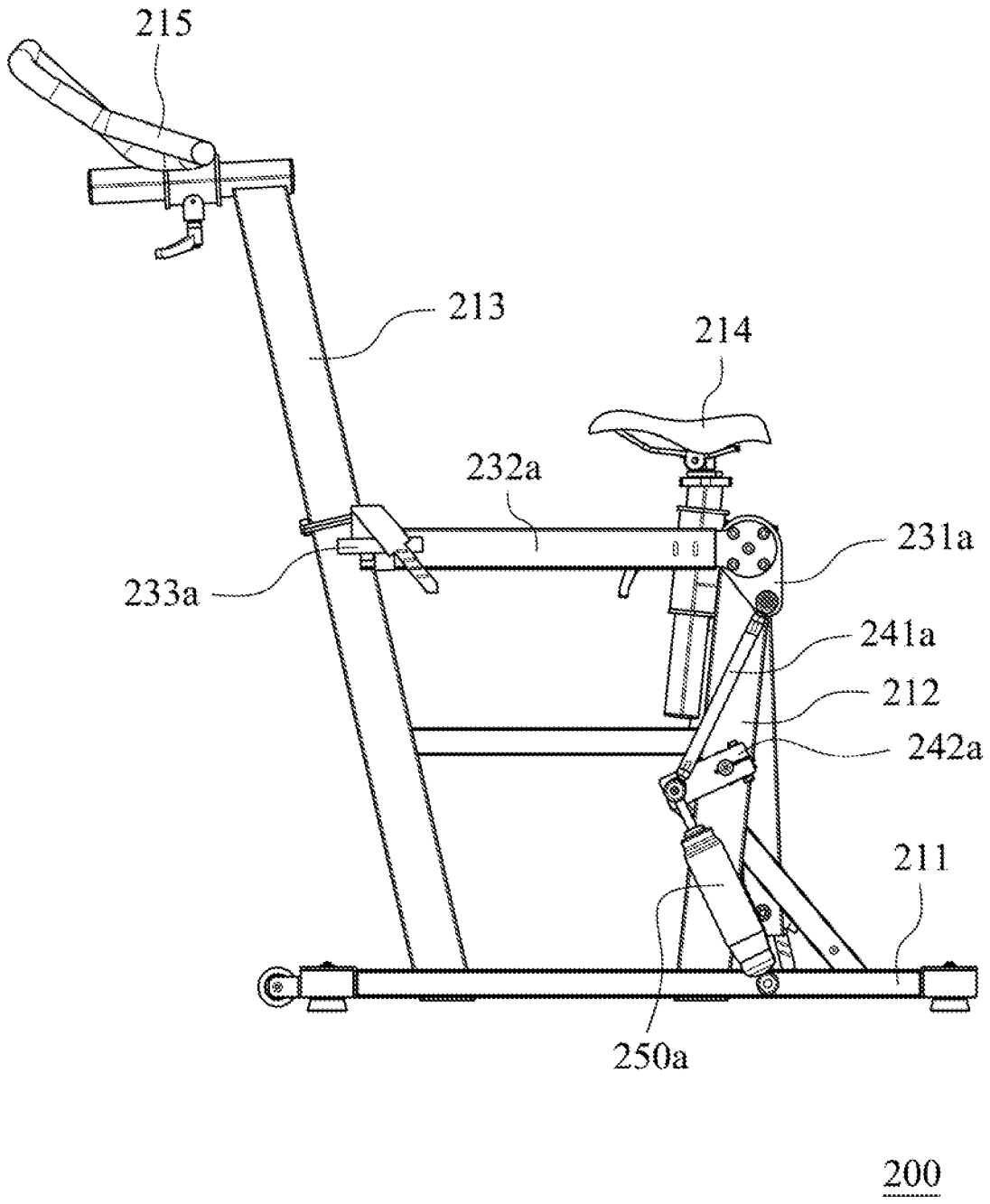
FIG. 9C is a schematic view of yet another using state of the magnetic resistance device of FIG. 8.

FIGS. 9A, 9B and 9C are schematic views of three using states of the magnetic resistance device 250*a* of FIG. 8. In FIG. 9A, the driving member 232*a* is perpendicular to the ground, at this time, the piston rod 254*a* is not be driven, and there is no movement between the magnets 252*a* and the conductive member 253*a*, thus, no magnetic resistance is generated. In FIGS. 9B and 9C, the driving member 232*a* is swung from the first supporting base 212 to the second supporting base 213, the pivoting member 231*a* is linked up with the driving member 232*a*, and links up with the first linkage rod 241*a*. When the first linkage rod 241*a* is linked up with the pivoting member 231*a*, the piston rod 254*a* of the magnetic resistance device 250*a* is pushed, so that the magnet 252*a* disposed on the piston rod 254*a* is moved within the cylinder case 251*a*. Therefore, the movement between the magnet 252*a* and the conductive member 253*a* which is disposed on the inner wall of the cylinder case 251*a* for generating the magnetic resistance.

Figure 10A:
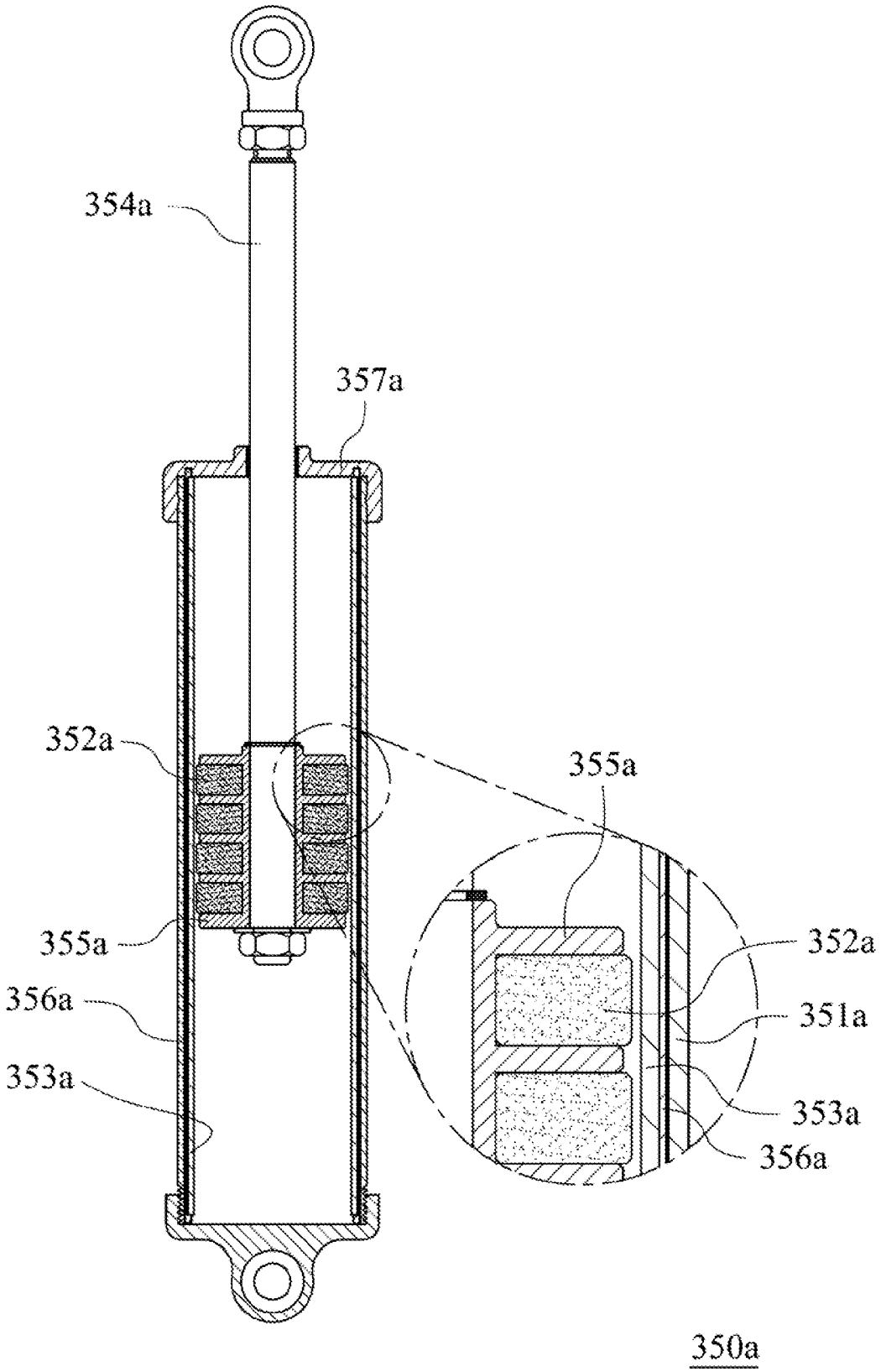
FIG. 10A shows a cross-sectional view of a magnetic resistance device of the high knees exercise apparatus according to yet another embodiment of the present disclosure.

FIG. 10A shows a cross-sectional view of a magnetic resistance device 350*a* of the high knees exercise apparatus according to yet another embodiment of the present disclosure. In FIG. 10A, the magnetic resistance device 350*a* further includes a magnet base 355*a*, a rotating base 356*a* and an adjusting cover 357*a*. The magnet base 355*a* can include a plurality of layer frames and the magnets 352*a* can be arranged on the layer frames. Therefore, the magnets can be moved stably. The rotating base 356*a* is rotably connected to the inner wall of the cylinder case 351*a* and a plurality of the conductive members 353*a* is disposed on the rotating base 356*a*. The adjusting cover 357*a* is rotatbly connected to the open end of the cylinder case 351*a*, and linked up with the rotating base 356*a*, wherein the piston rod 354*a* is passed through the adjusting cover 357*a* and inserted into the cylinder case 351*a*.

Figure 10B:
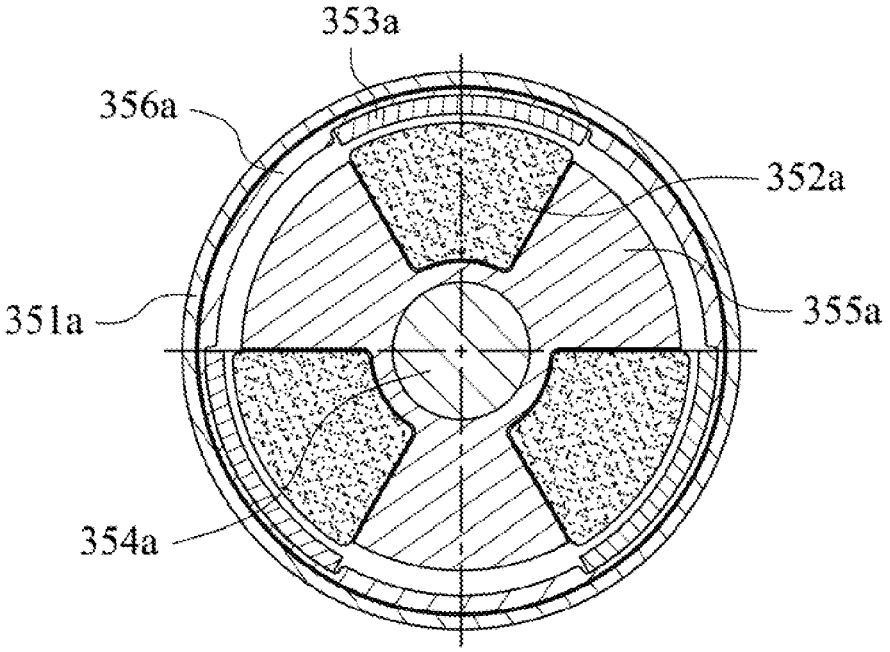
FIG. 10B shows a cross-sectional view of the magnetic resistance device along line 10B-10B of FIG. 10A.

FIG. 10B shows a cross-sectional view of the magnetic resistance device 350*a* along line 10B-10B of FIG. 10A. In FIG. 10B, number of the conductive members 353*a* is three and equally arranged on the rotating base 356*a*. There are three magnets 352*a* located on each of the layer frames of the magnet base 355*a*. When the entire side surface of each magnet 352*a* is faced to each conductive member 353*a*, the magnetic resistance is largest.

Figure 10C:
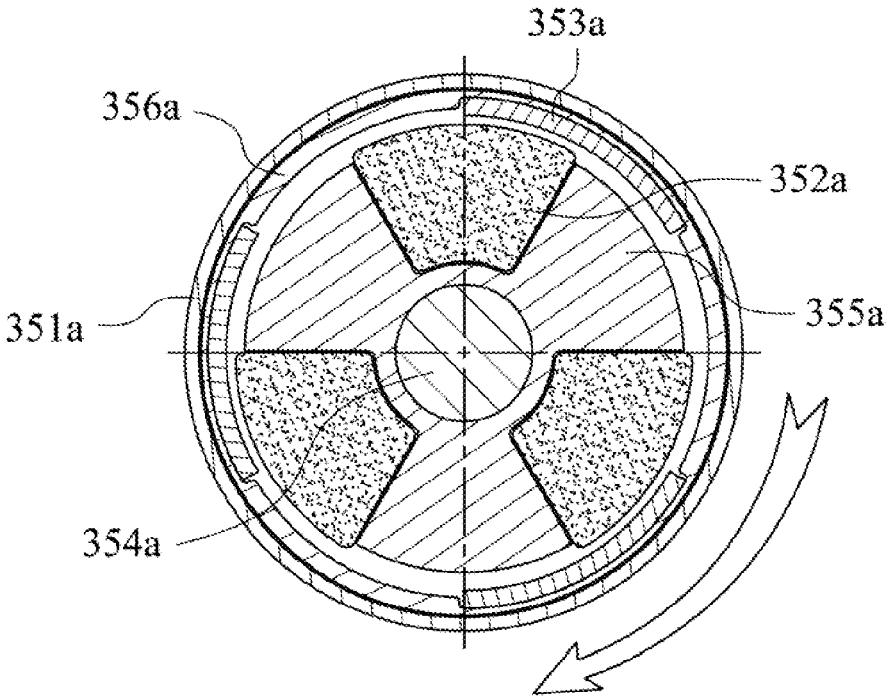
FIG. 10C shows a cross-sectional view of another state of the magnetic resistance device of FIG. 10B.

FIG. 10C shows a cross-sectional view of another state of the magnetic resistance device 350*a* of FIG. 10B. When the adjusting cover 357*a* is turned, the rotating base 356*a* is rotated and the conductive members 353*a* thereon is moved. Therefore, partial surface of each magnet 352*a* is not faced to each conductive member 353*a*, thus, the magnetic resistance is smaller during the piston rod 354*a* is driven.

Figure 11:
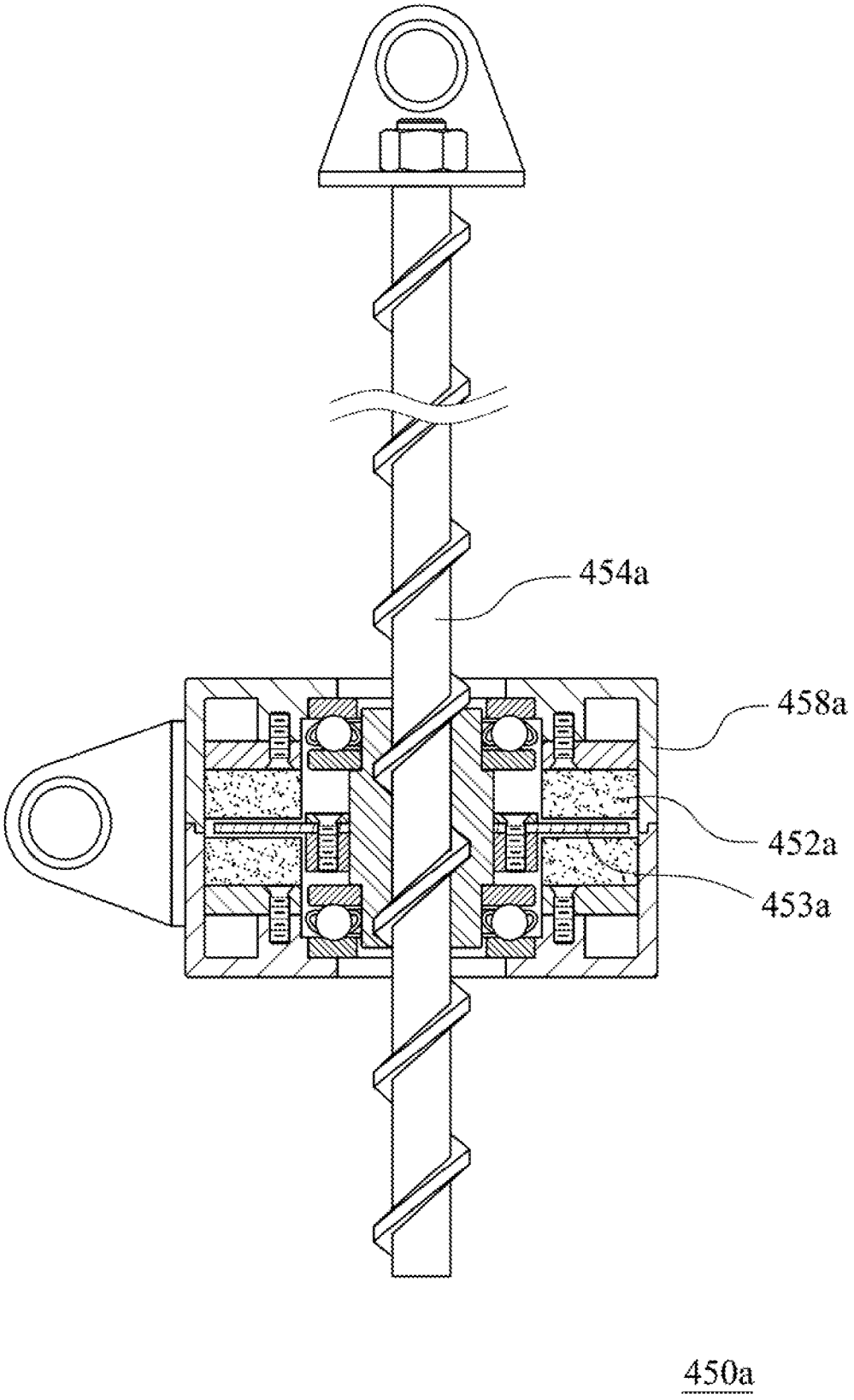
FIG. 11 show a schematic views of a magnetic resistance device of the high knees exercise apparatus according to further another embodiment of the present disclosure.

FIG. 11 show a schematic views of a magnetic resistance device 450*a* of the high knees exercise apparatus according to further another embodiment of the present disclosure, wherein the cylinder case of the magnetic resistance device 450*a* will not be shown in FIG. 11. In FIG. 11, the piston rod 454*a* is a screw rod. The magnetic resistance component assembly includes a plurality of magnets 452*a*, a conductive member 453*a* and a magnet case 458*a*, wherein the magnets 452*a* and the conductive member 453*a* is located in the magnet case 458*a*. The magnets 452*a* is connected to two inner side of the magnet case 458*a*, and the magnets 452*a* on each inner side is faced to the surface of the conductive member 453*a*. The piston rod 454*a* is inserted through the conductive member 453*a* and the magnet case 458*a*, wherein the conductive member 453*a* is linked up with the piston rod 454*a*, so that when the piston rod 454*a* is moved, the conductive member 453*a* is rotated, and the movement between the magnet 452*a* and the conductive member 453*a* is provided. Especially, the piston rod 454*a* is a screw rod, so that the rotational speed of the conductive member 453*a* can be increased, and the magnetic resistance can also be increased.

Figure 12:
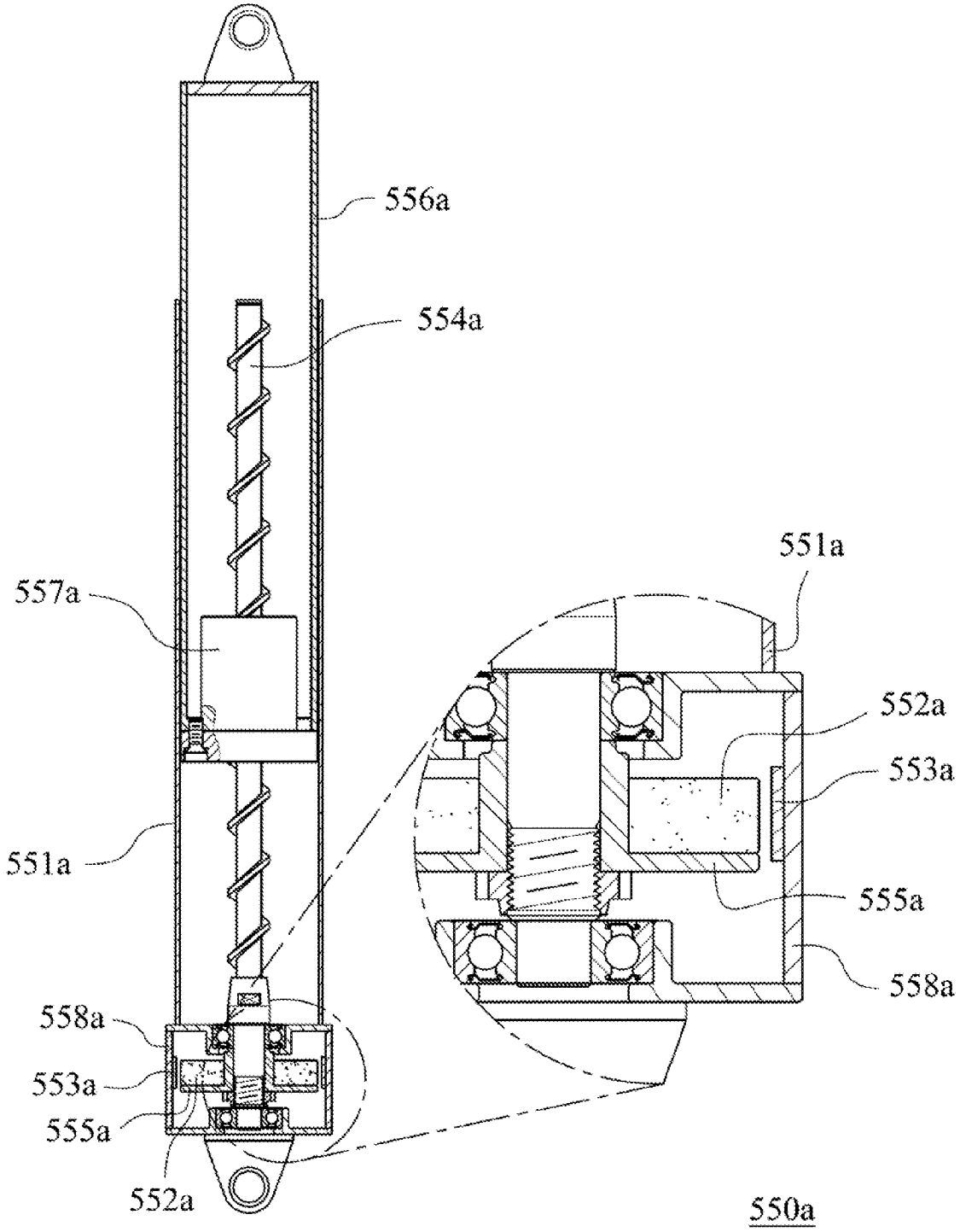
FIG. 12 show a schematic views of a magnetic resistance device 550*a* of the high knees exercise apparatus according to still another embodiment of the present disclosure.

FIG. 12 show a schematic views of a magnetic resistance device 550*a* of the high knees exercise apparatus according to still another embodiment of the present disclosure. In FIG. 12, the magnetic resistance device 550*a* includes a cylinder case 551*a*, a magnet case 558*a*, a magnet 552*a*, a conductive member 553*a*, a magnet base 555*a*, a piston rod 554*a*, a telescopic tube 556*a* and a ball screw cap 557*a*. The magnet case 558*a* is fixed to one end of the cylinder case 551*a*, wherein the conductive member 553*a* is disposed on the inner wall of the magnet case 558*a*, and the magnet base 555*a* is located in the magnet case 558*a* and the magnet 552*a* is disposed on the magnet base 555*a*. One surface of the conductive member 553*a* is adjacent to one surface of the magnet 552*a*. The piston rod 554*a* is a ball screw rod which is located in the cylinder case 551*a*, wherein one end of the piston rod 554*a* is inserted to the magnet case 558*a* and connected to the magnet base 555*a*, so that the magnet 552*a* on the magnet base 555*a* can be rotated by the piston rod 554*a*. The ball screw cap 557*a* is located in the telescopic tube 556*a* and is inserted by the piston rod 554*a*. When the telescopic tube 556*a* is driven, the piston rod 554*a* can be rotated by the ball screw cap 557*a*, and the magnet 552*a* on the magnet base 555*a* can be linked up. Therefore, the magnetic resistance can be generated.

Figure 13:
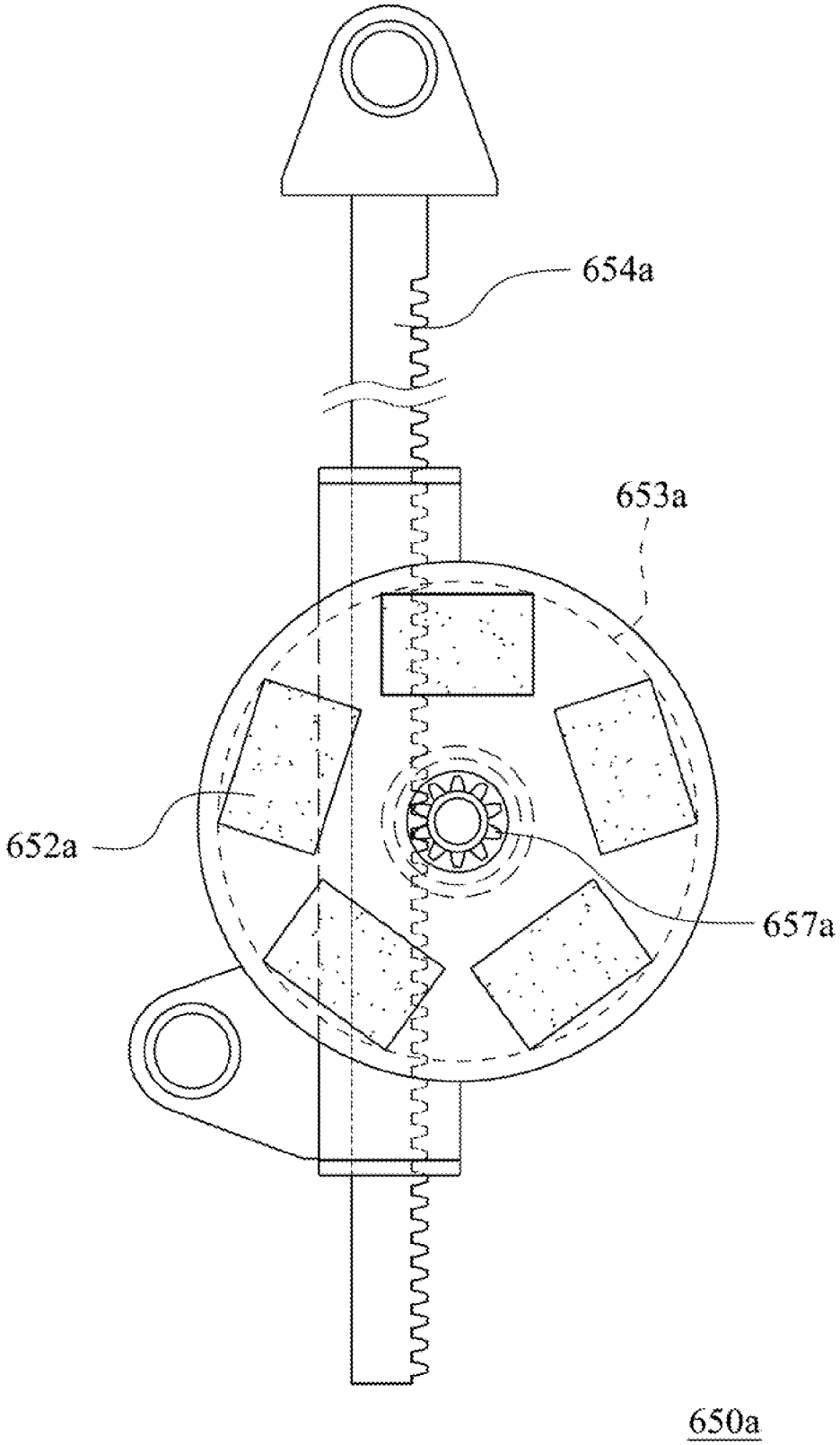
FIG. 13 show a schematic views of a magnetic resistance device 650*a* of the high knees exercise apparatus according to still another embodiment of the present disclosure.

FIG. 13 show a schematic views of a magnetic resistance device 650*a* of the high knees exercise apparatus according to still another embodiment of the present disclosure. In FIG. 13, the magnetic resistance device 650*a* includes a cylinder case (not shown), a plurality of magnets 652*a*, a conductive member 653*a*, a piston rod 654*a* and a gear 657*a*. The magnets 652*a* is disposed on the inner wall of the cylinder case, and is adjacent to two surfaces of the conductive member 653*a*. The gear 657*a* is located on the center of the conductive member 653*a*. The piston rod 654*a* is a gear rack, and is meshed to the gear 657*a*. When the piston rod 654*a* is driven, the gear 657*a* can be rotated and links up with the conductive member 653*a*. Therefore, the conductive member 653*a* can be rotated, and the movement between the magnet 652*a* and the conductive member 653*a* is provided for generating the magnetic resistance.

Figure 14:
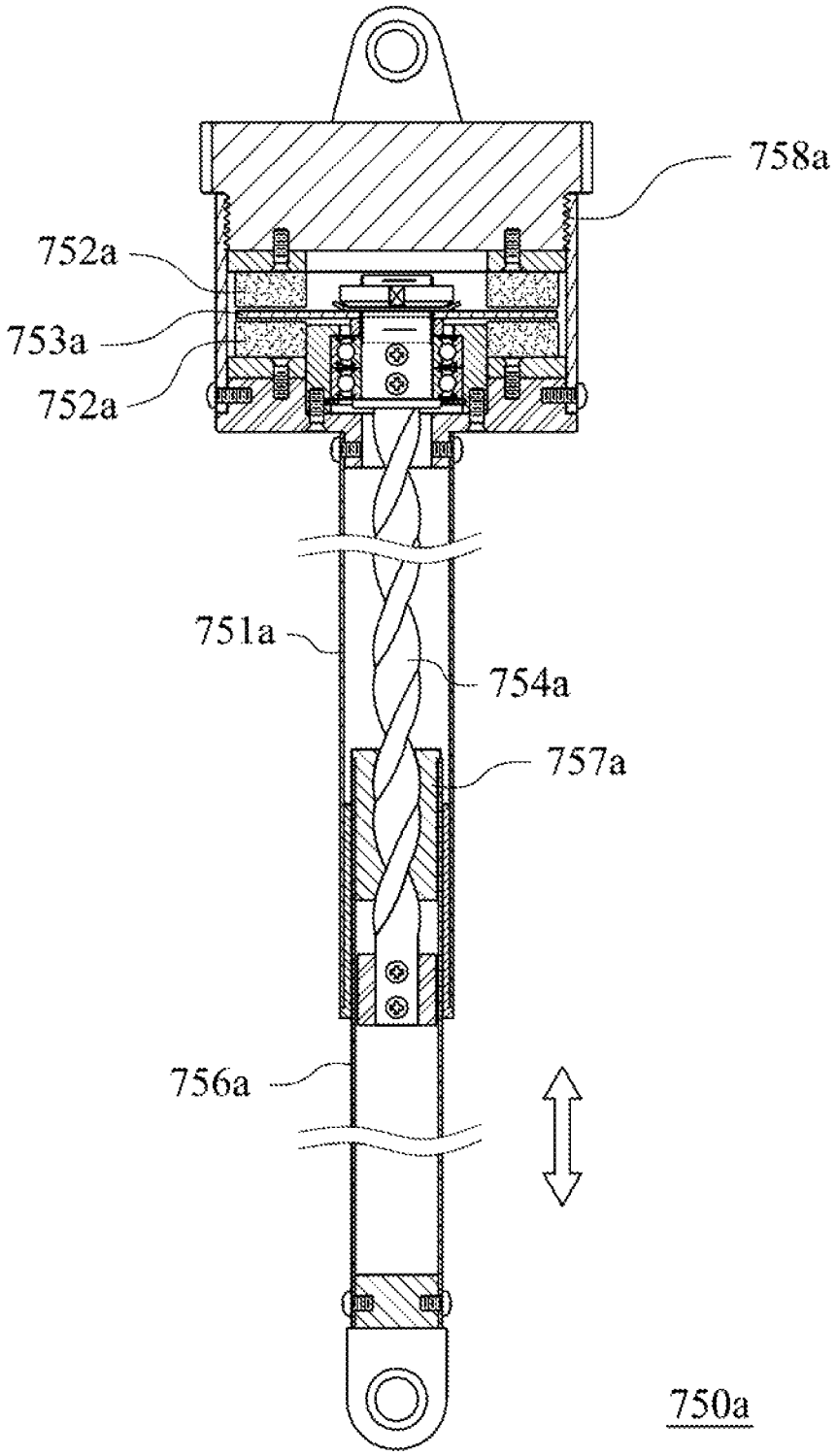
FIG. 14 show a schematic views of a magnetic resistance device of the high knees exercise apparatus according to still another embodiment of the present disclosure.

FIG. 14 show a schematic views of a magnetic resistance device 750*a* of the high knees exercise apparatus according to still another embodiment of the present disclosure. In FIG. 14, the magnetic resistance device 750*a* includes a cylinder case 751*a*, a magnet case 758*a*, a plurality of magnets 752*a*, a conductive member 753*a*, a piston rod 754*a*, a telescopic tube 756*a* and a twist screw cap 757*a*. The magnet case 758*a* is connected to the bottom base 211 and one end of the cylinder case 751*a*. In the magnet case 758*a*, the magnets 752*a* is arranged on two inner end walls of the magnet case 758*a*, and the magnets 752*a* are adjacent to two surfaces of the conductive member 753*a*. The piston rod 754*a* is a twist screw rod which is located in the cylinder case 751*a*, wherein one end of the piston rod 754*a* is inserted to the magnet case 758*a* and coaxially connected to the conductive member 753*a*, so that the conductive member 753*a* can be rotated by the piston rod 754*a*. The twist screw cap 757*a* is located in the telescopic tube 756*a* and is inserted by the piston rod 754*a*. When the telescopic tube 756*a* is driven, the piston rod 754*a* can be rotated by the twist screw cap 757*a*, and the conductive member 753*a* in the magnet case 758*a* can be linked up. Therefore, the magnetic resistance can be generated.

Figure 15:
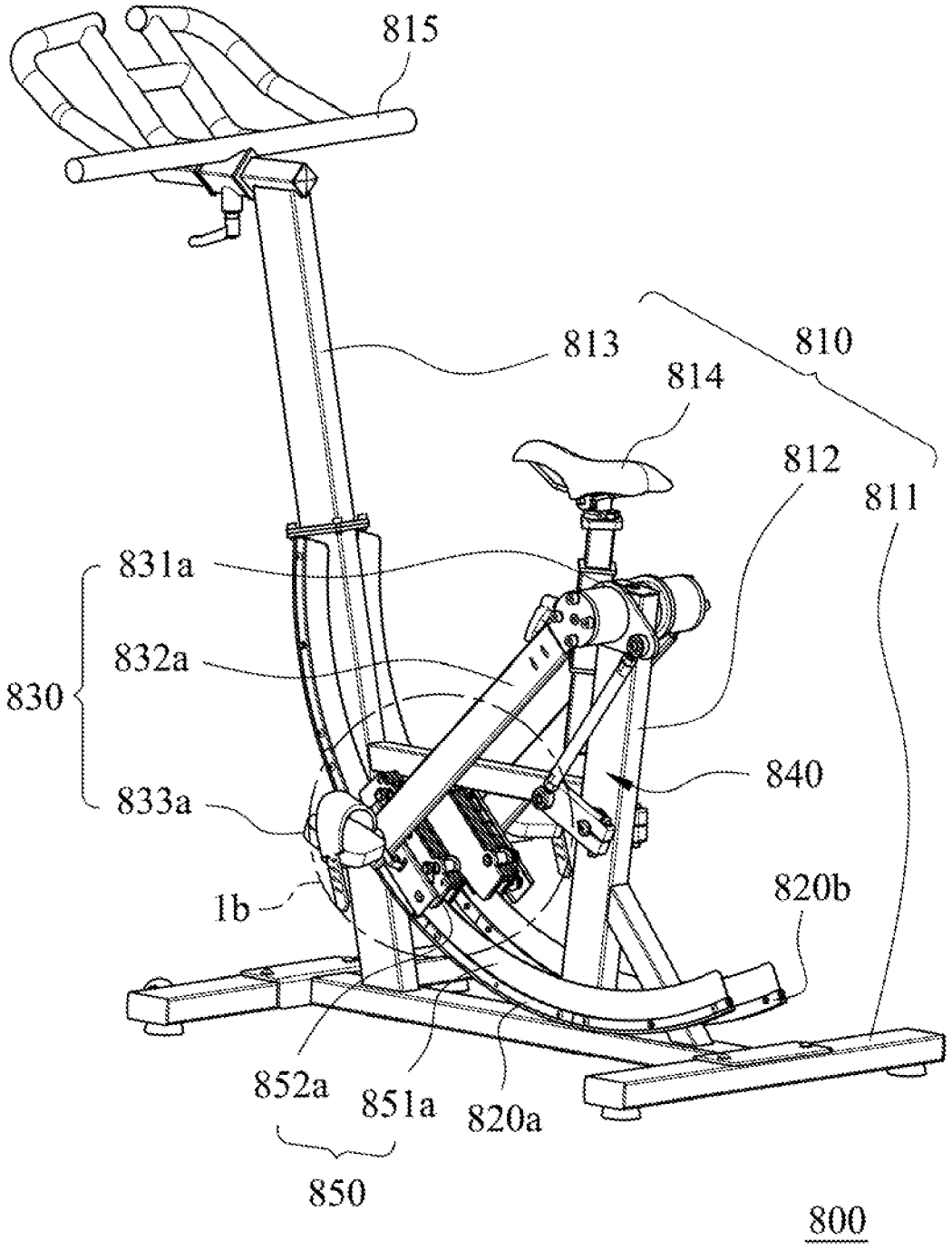
FIG. 15 shows a three dimensional view of a high knees exercise apparatus according to yet another embodiment of the present disclosure.

FIG. 15 shows a three dimensional view of a high knees exercise apparatus 800 according to yet another embodiment of the present disclosure. In FIG. 15, the high knees exercise apparatus 800 includes a base 810, two slide rails 820*a*, 820*b*, a driving member 830, a linkage mechanism 840 and two magnetic resistance devices 850*a*, 850*b*. The mentioned elements and the relationships among the mentioned element are arranged as the aforementioned embodiment of FIG. 1, and will not state again herein.

Figure 16A:
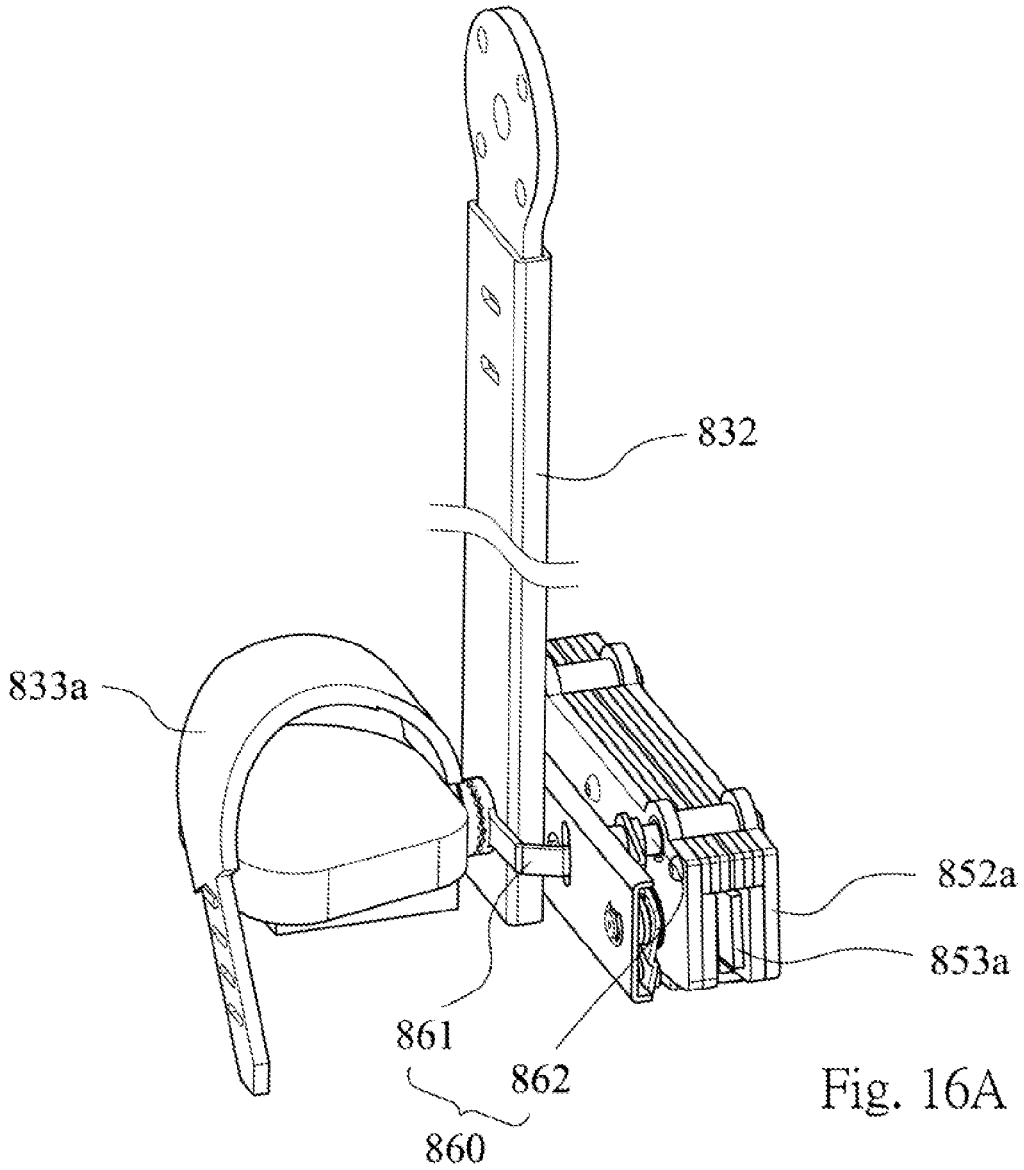
FIG. 16A shows a schematic view of a resistance adjusting device of the high knees exercise apparatus of FIG. 15.
Figure 16B:
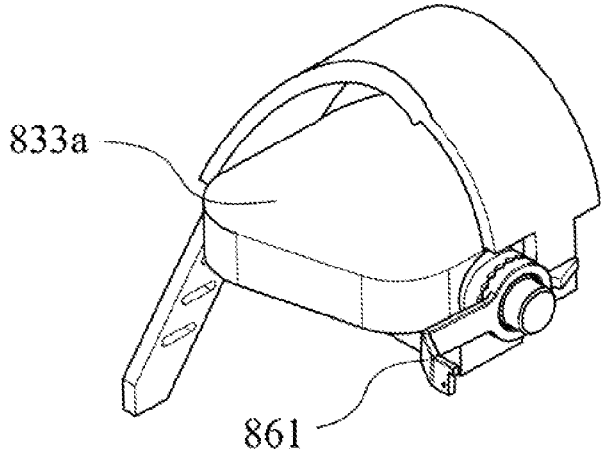
FIG. 16B shows a schematic view of a shift shaft of the resistance adjusting device of FIG. 16A.

FIG. 16A shows a schematic view of a resistance adjusting device 860 of the high knees exercise apparatus 800 of FIG. 15. FIG. 16B shows a schematic view of a shift shaft 861 of the resistance adjusting device 860 of FIG. 16A. In FIGS. 16A and 16B, the resistance adjusting device 860 includes two shift mechanisms, each of the shift mechanisms (only one be shown in FIG. 16A) includes a shift shaft 861 and a linking shaft 862. One end of the shift shaft 861 is connected to the pedal 833*a*, so that the shift shaft 861 is linked up with the pedal 833*a*. One end of the linking shaft 862 is connected to the shift shaft 861, the other end of the linking shaft 862 is connected to the magnet base 852*a*. Therefore, the user can shift the pedal 833*a* for linking up the shift shaft 861, and the linking shaft 862 can also be linked up with the shift shaft 861 for moving the magnet base 852*a*, so that the relative position between the magnets 853*a* and the conductive member 851*a* can be changed. Thus, the magnetic resistance can be adjusted.

Figure 17A:
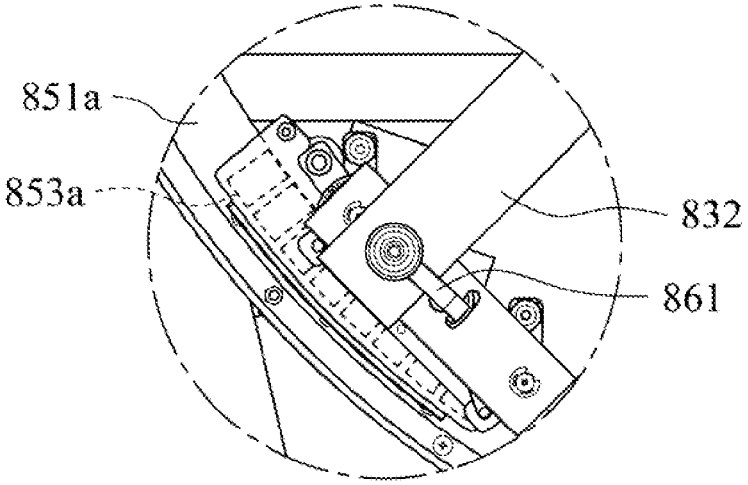
FIG. 17A is schematic views of one using states between the magnet base and the conductive member of the high knees exercise apparatus of FIG. 15.
Figure 17B:
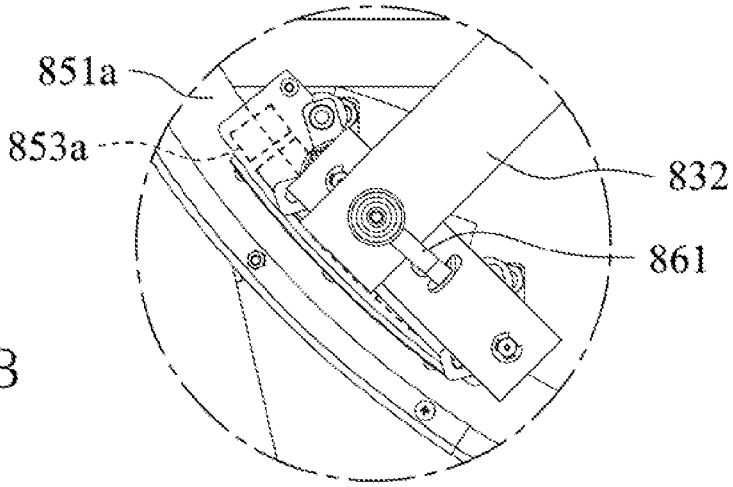
FIG. 17B is schematic views of another using states between the magnet base and the conductive member of the high knees exercise apparatus of FIG. 15.
Figure 17C:
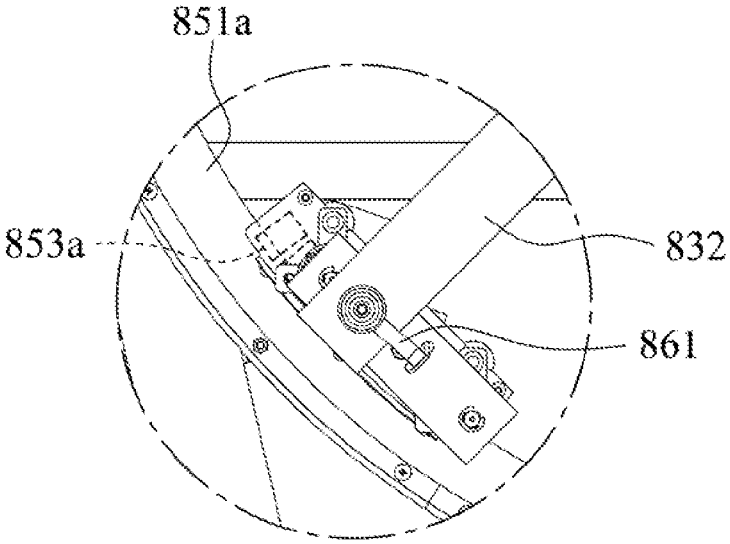
FIG. 17C is schematic views of the other using states between the magnet base and the conductive member of the high knees exercise apparatus of FIG. 15.

FIGS. 17A, 17B and 17C are schematic views of three using states between the magnet base 853*a* and the conductive member 851*a* of the high knees exercise apparatus 800 of FIG. 15. In FIGS. 17A, 17B and 17C, the relative position between the magnets 853*a* and the conductive members 851*a* can be changed by driving the shift shaft 861 and the linking shaft 862 via the pedal 833*a*.

Figure 18A:
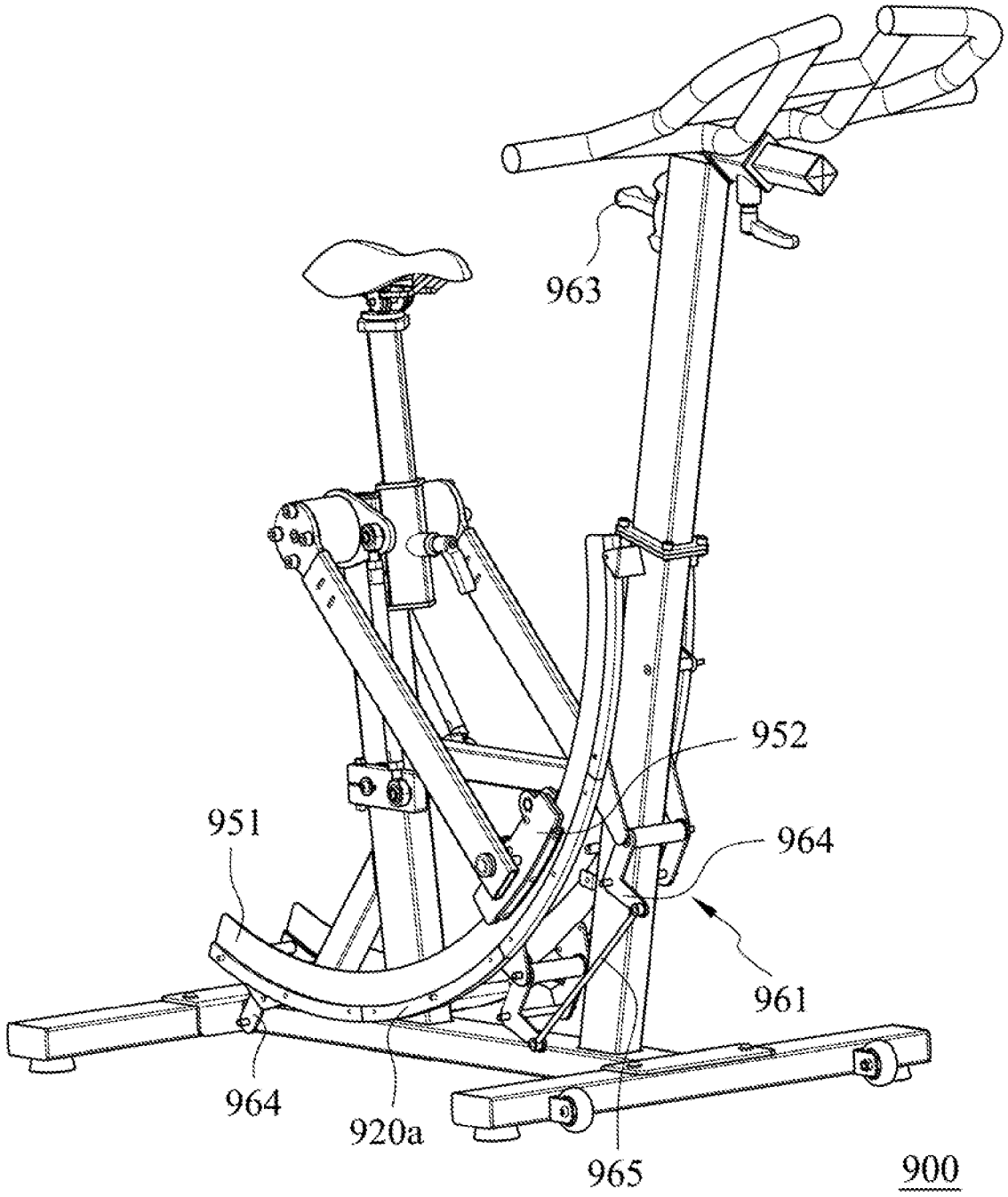
FIG. 18A is a three dimensional view of a high knees exercise apparatus according to still another embodiment of the present disclosure.
Figure 18B:
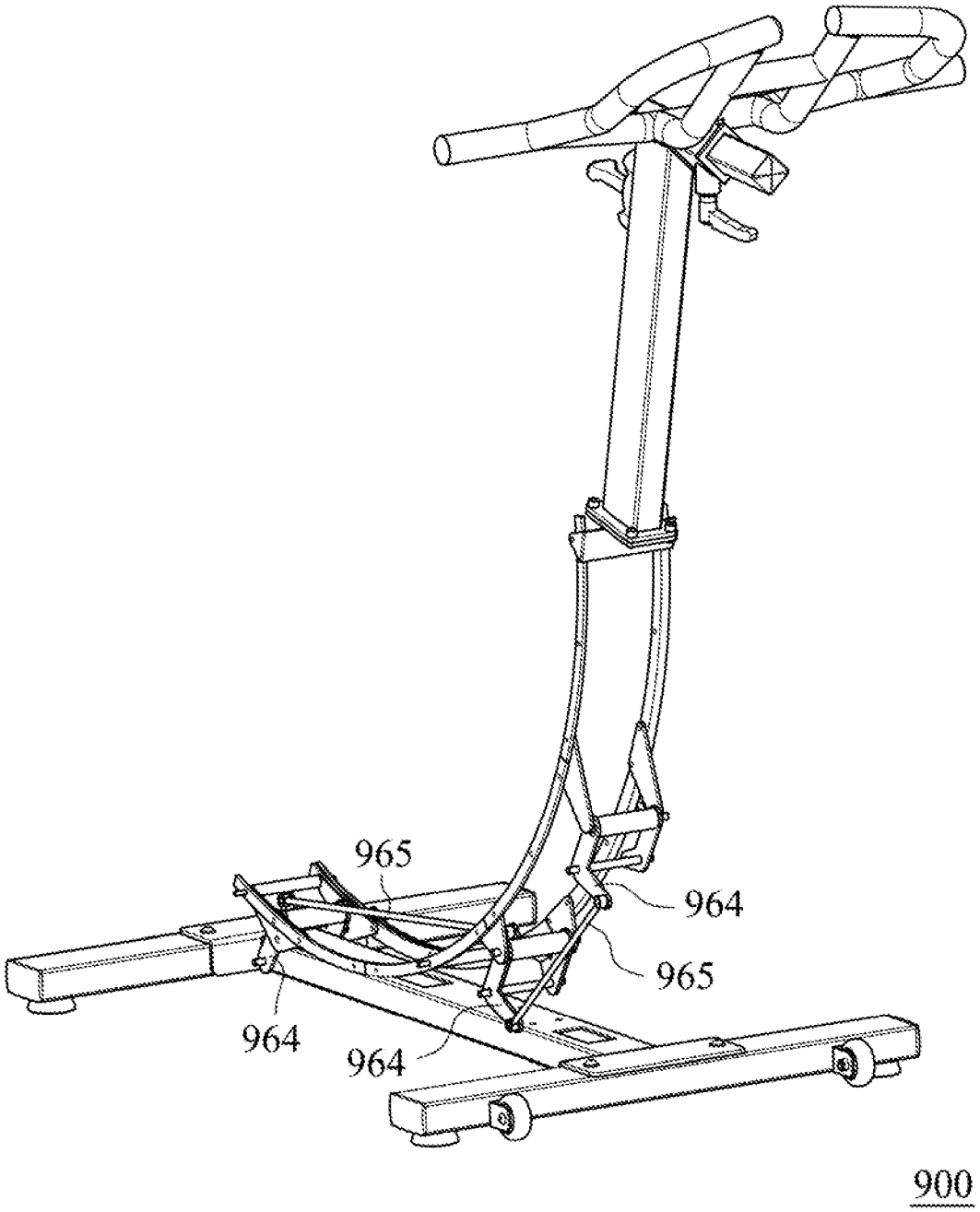
FIG. 18B shows a three dimensional view of a forcing mechanism of the high knees exercise apparatus of FIG. 18A.

FIG. 18A is a three dimensional view of a high knees exercise apparatus 900 according to still another embodiment of the present disclosure. FIG. 18B shows a three dimensional view of a forcing mechanism 961 of the high knees exercise apparatus 900 of FIG. 18A. In FIGS. 18A and 18B, the resistance adjusting device of the high knees exercise apparatus 900 includes a forcing mechanism 961 and a controlling member 963, wherein the forcing mechanism 961 is connected to the slide rails 920*a*, 920*b* for adjusting an embedded position between the magnet bases 952 and the conductive member 951, and the controlling member 963 is connected to the forcing mechanism 961.

In detail, the forcing mechanism 961 includes a plurality of operating assemblies 964 and a plurality of linkage members 965, wherein each of the operating assemblies 964 is connected to and linked up with each other via each of the linkage members 965. In FIGS. 18A and 18B, the forcing mechanism 961 includes three operating assemblies 964 and two linkage members 965.

Figure 19A:
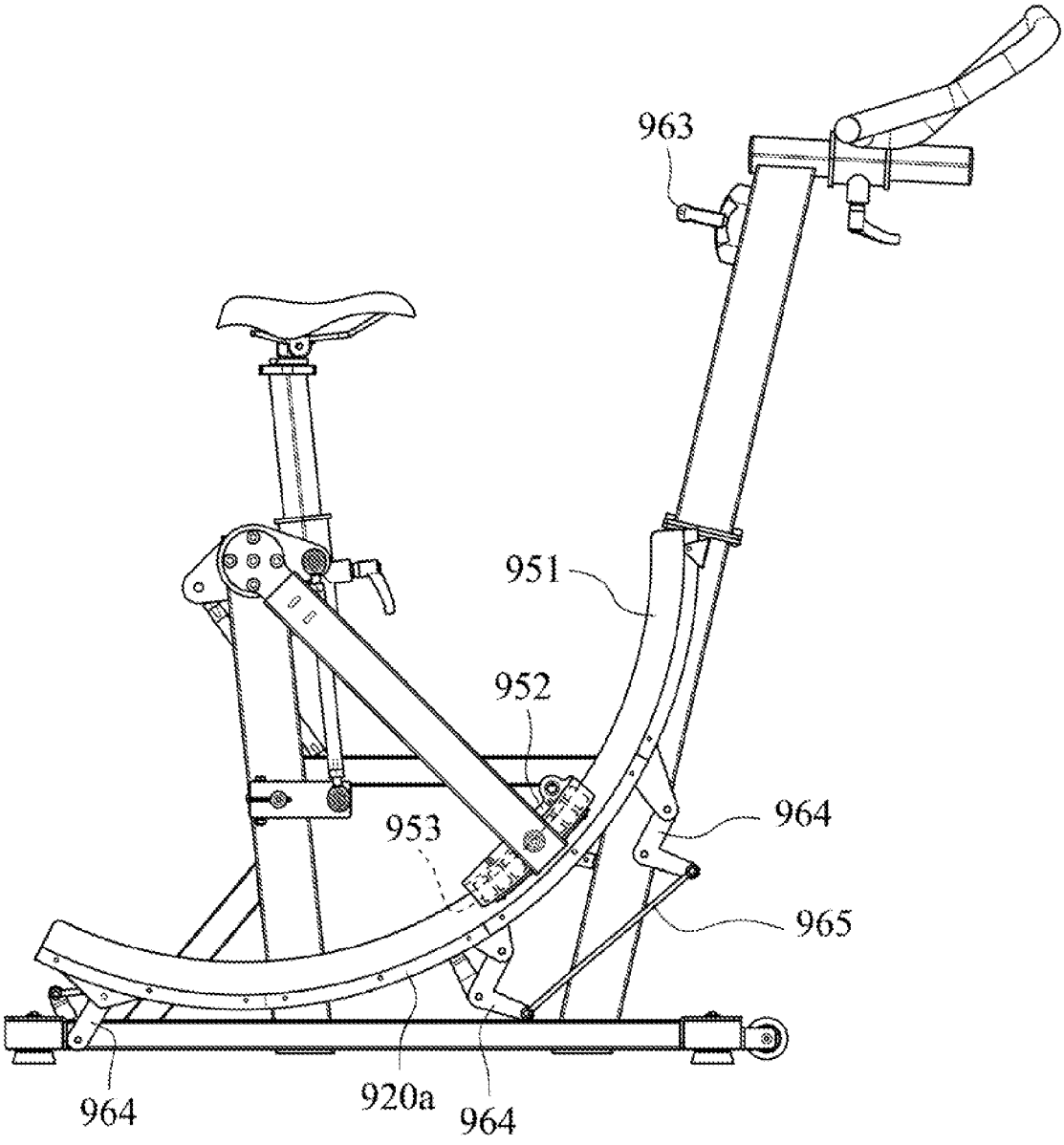
FIG. 19A is schematic views of one using states of the high knees exercise apparatus of FIG. 18A.
Figure 19B:
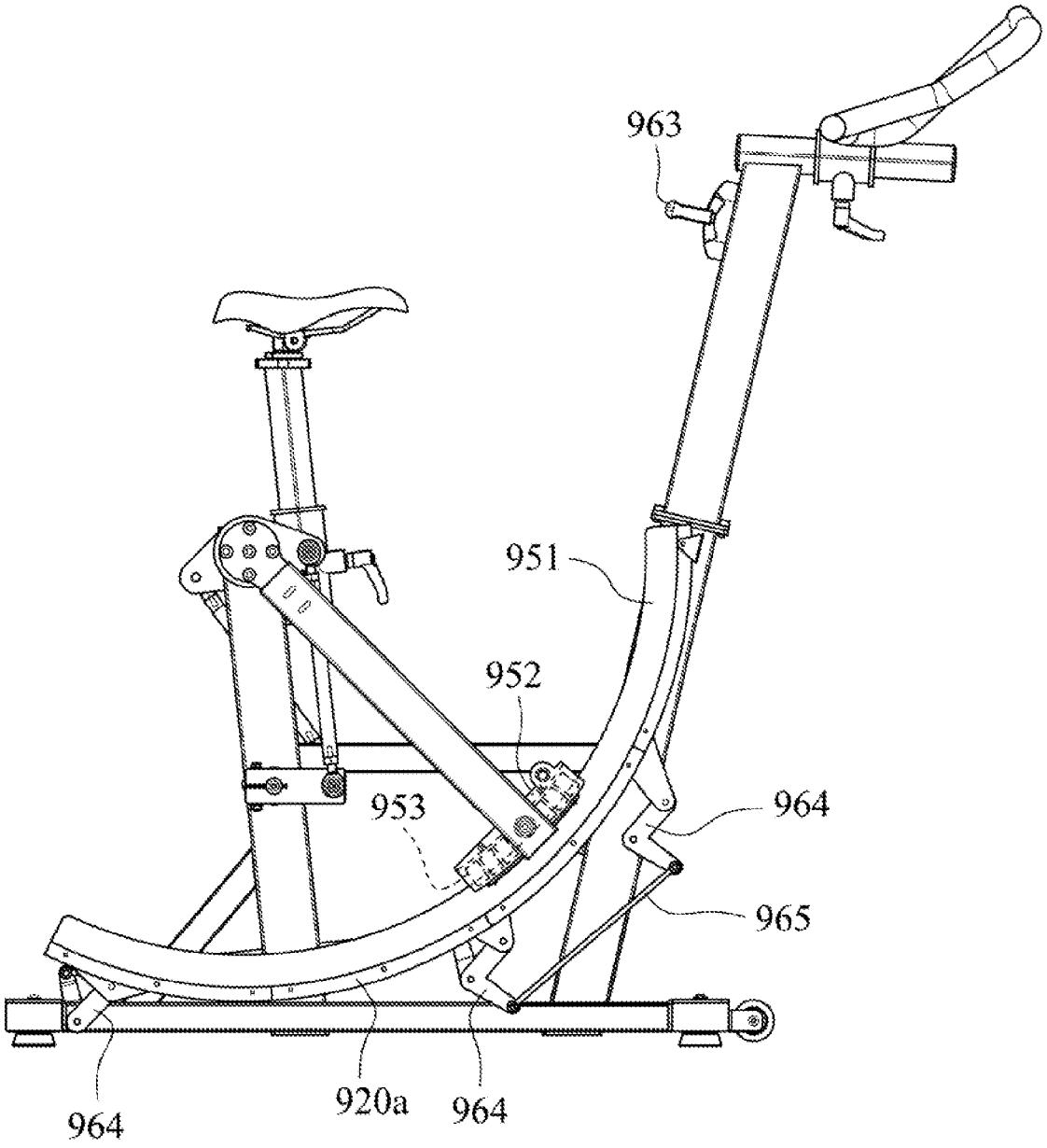
FIG. 19B is schematic views of the other using states of the high knees exercise apparatus of FIG. 18A.

FIG. 19A and FIG. 19B are schematic views of two using states of the high knees exercise apparatus 900 of FIG. 18A. In FIG. 19A, the adjacent area of the magnets 953 and the conductive member 951 is largest, so that the high knees exercise apparatus 900 can provide the maximum of the magnetic resistance during driving. In FIG. 19B, when the user pulls the controlling member 963, one of the operating assemblies 964 is moved, and other operating assemblies 964 are linked up via the linkage members 965. Therefore, the slide rails 920*a*, 920*b* can be moved. The conductive members 951 disposed on the slide rail 920*a* can also be moved, that is, the relative position (adjacent area) between the surface of the magnets 953 in the magnet base 952 and the surface of the conductive member 951 can be changed, and the magnetic resistance is adjusted (decreased).

Figure 20:
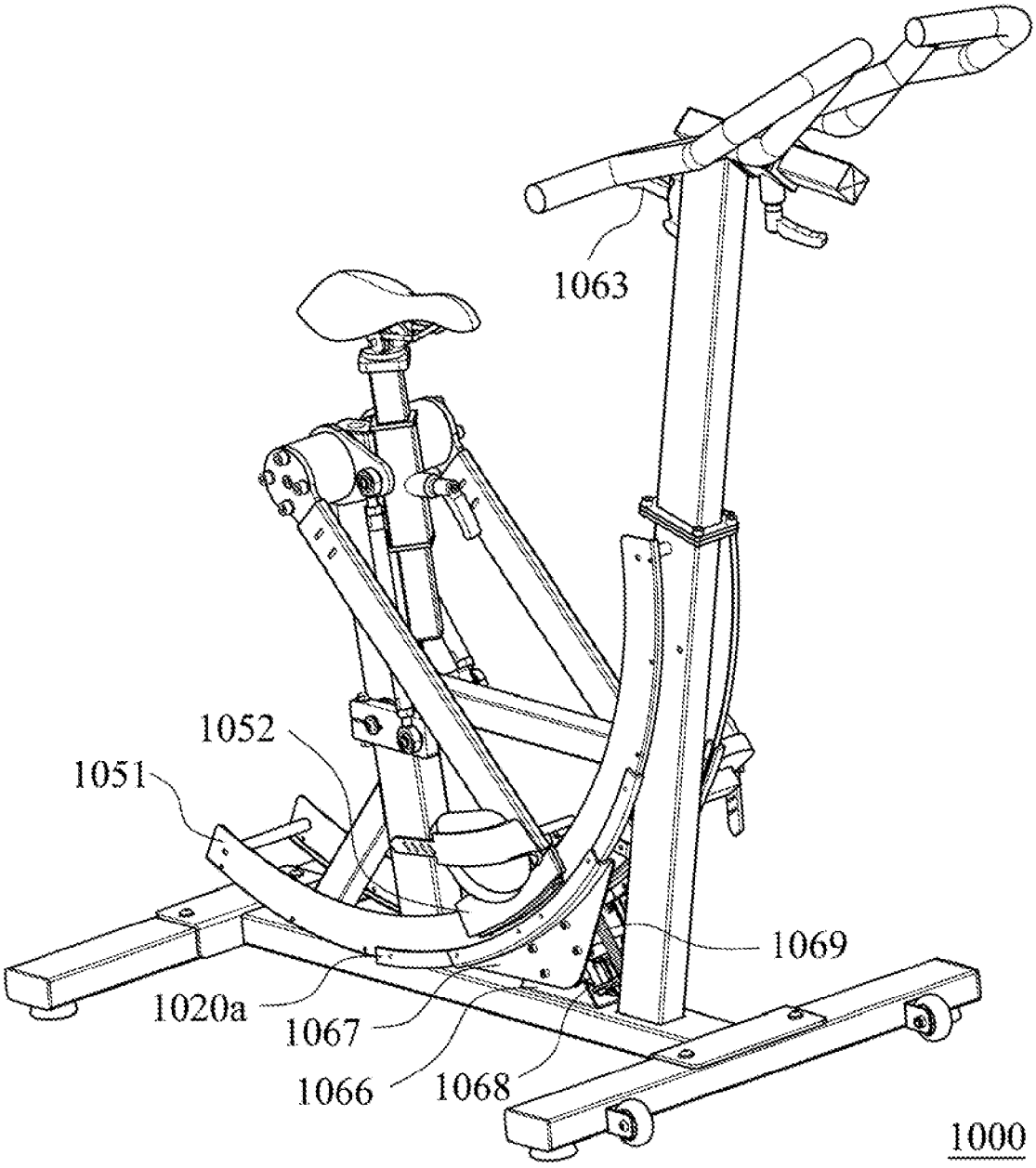
FIG. 20 is a side view of a high knees exercise apparatus according to further another embodiment of the present disclosure.

FIG. 20 is a side view of a high knees exercise apparatus 1000 according to further another embodiment of the present disclosure. In FIG. 19, the resistance adjusting device of the high knees exercise apparatus 1000 includes a forcing mechanism 1061 and a controlling member 1063, wherein the forcing mechanism 1061 is connected to the slide rails 1020*a* for adjusting an embedded position between the magnet bases 1052 and the conductive member 1051, and the controlling member 1063 is connected to the forcing mechanism 1061.

In detail, the forcing mechanism 1061 includes a forcing base 1066, a linkage member 1067, at least one operating rod 1068 and a restoring member 1069, wherein the linkage member 1067 is movably connected to the forcing base 1066, at least one operating rod 1068 and a restoring member 1069 are located in the forcing base 1066, and the linkage member 1067 is moved by at least one operating rod 1068 and a restoring member 1069 (such as a spring). The operating rod 1068 can be driven by electric device (such as motor) or non-electric device (calm wheel) for pushing or pulling the linkage member 1067 to move the slide rails 1020*a*. When the operating rod 1068 pushes the slide rails 1020*a*, the restoring member 1069 would be compressed. The restoring member 1069 can provide a restoring force for pulling the linkage member 1067 and the slide rails 1020*a* back. Therefore, the relative position between the surface of the magnets (not be labeled) in the magnet base 1052 and the surface of the conductive member 1051 which is disposed on the slide rails 1020*a* can be changed, and the magnetic resistance is adjusted.

By such arrangement, the high knees exercise apparatus would not provide inertia during working, so that the security of the high knees exercise apparatus is enhanced.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A high knees exercise apparatus, comprising:

a base, comprising:

a bottom base;

a first supporting base disposed on the bottom base;

a second supporting base disposed on the bottom base; and a seat base disposed on the first supporting base;

a driving mechanism, comprising:

two pivoting members, one of the pivoting members symmetrically and pivotally connected to each of two sides of the first supporting base;

two driving members, one end of each of the driving members connected to each of the pivoting members, wherein each of the driving members is swung along an arc path; and two pedals, one of the pedals connected to each of the driving members;

a linkage mechanism connected with the pivoting members to maintain reciprocal motion of the driving members relative to each other; and two magnetic resistance devices configured to provide a magnetic resistance in in response to swinging of the two driving members;

wherein each of the magnetic resistance devices comprises:

a cylinder case disposed on the bottom base;

a magnetic resistance component assembly located in the cylinder case, wherein the magnetic resistance component assembly comprises:

a magnet; and a conductive member adjacent to the magnet; and a piston rod, wherein one end of the piston rod is connected to the linkage mechanism to provide movement between the magnet and the conductive member, so that magnetic resistance is generated.

2. The high knees exercise apparatus of claim 1, wherein the linkage mechanism comprises:

two first linkage rods, each of the first linkage rods has two ends, wherein one of the two ends of each of the first linkage rods is connected to one of the pivoting members;

two second linkage rods, each of the second linkage rods has two ends, wherein one of the two ends of each of the second linkage rods is pivotally connected to the other end of the two ends of each of the first linkage rods; and a rotatable axis having two ends and pivotally connected through the first supporting base, wherein one of the two ends of the rotatable axis is disposed one each of two sides of the first supporting base, and the other one of the two ends of each of the second linkage rods is pivotally connected to each of the two ends of the rotatable axis.

3. The high knees exercise apparatus of claim 1, wherein the conductive member is made of copper, silver, aluminum or steel.

4. The high knees exercise apparatus of claim 1, wherein the magnetic resistance component assembly further comprises a second magnet, wherein the magnetic resistance component assembly is located in the cylinder case, the magnets surrounds the piston rod, and the conductive member is connected to an inner wall of the cylinder case.

5. The high knees exercise apparatus of claim 4, further comprising:

two resistance adjusting devices, each of the resistance adjusting devices for changing a relative position between the magnets and the conductive member of each of the magnetic resistance devices.

6. The high knees exercise apparatus of claim 5, wherein each of the resistance adjusting devices comprises:

a rotating base, wherein the conductive member is connected to the inner wall of the cylinder case via the rotating base; and an adjusting cover rotatbly connected to the cylinder case and linked up with the rotating base.

7. The high knees exercise apparatus of claim 1, wherein each piston rod is a screw rod.

8. The high knees exercise apparatus of claim 1, wherein the piston rod of each of the magnetic resistance devices is a ball screw rod.

9. The high knees exercise apparatus of claim 8, wherein each of the magnetic resistance devices comprises:

a telescopic tube movably inserted into the cylinder case; and a ball screw cap located in the telescopic tube and is inserted by the piston rod for rotating the piston rod.

10. The high knees exercise apparatus of claim 1, wherein the piston rod of each of the magnetic resistance devices is a twist screw rod.

11. The high knees exercise apparatus of claim 10, wherein each of the magnetic resistance devices comprises:

a telescopic tube movably inserted into the cylinder case; and a twist screw cap located in the telescopic tube and is inserted by the piston rod for rotating the piston rod.

12. The high knees exercise apparatus of claim 1, wherein the piston rod is a gear rack, and the magnetic resistance device further comprises a gear, wherein the gear is rotated by the piston rod and links up with the conductive member.

* * * * *